US005338149A

United States Patent [19]

Wiseman

[11] Patent Number: 5,338,149

[45] Date of Patent: Aug. 16, 1994

[54] SIGNATURE STACKER

[75] Inventor: Raymond Wiseman, Littleton, Colo.

[73] Assignee: IDAB Incorporated, Hialeah, Fla.

[21] Appl. No.: 634,809

[22] Filed: Dec. 31, 1990

Related U.S. Application Data

[63] Continuation of Ser. No. 410,013, Sep. 19, 1989, abandoned, which is a continuation of Ser. No. 303,056, Jan. 27, 1989, abandoned, which is a continuation of Ser. No. 595,239, Apr. 2, 1984, abandoned.

[51] Int. Cl.[5] ..... B65G 57/03

[52] U.S. Cl. ..... 414/792.7; 198/801; 271/218; 414/793.6; 414/786

[58] Field of Search ..... 198/801, 859; 271/190, 271/218; 414/786, 788.1, 792.7, 793.5, 793.6, 794.4

[56] References Cited

U.S. PATENT DOCUMENTS

| | | | |
|---|---|---|---|
| 3,418,895 | 12/1968 | Palmer | 414/91 X |
| 3,479,932 | 11/1969 | Stal et al. | 271/218 X |
| 3,548,995 | 12/1970 | Oderman et al. | 271/218 X |
| 4,162,733 | 7/1979 | Wiseman | 414/78 |
| 5,024,569 | 6/1991 | Watts et al. | 414/790.3 |

*Primary Examiner*—Michael S. Huppert
*Assistant Examiner*—Janice Krizek
*Attorney, Agent, or Firm*—Finnegan, Henderson, Farabow, Garrett & Dunner

[57] ABSTRACT

A signature stream is intercepted by a bucket unlatched from the intercept position. The buckets are moved by drive chains. A spring assembly maintains tension upon the drive chains and spring loads the bucket in the "home" position, providing a detent action upon this bucket to accelerate the bucket and also provide a force for drop-out of the bucket. A bucket cam follower guides the bucket to move from a normal path to the "home" position. A microprocessor selectively halts each bucket during downward movement to reduce free fall time of signatures. A zero force cam engaged by the bucket cam follower counteracts the force otherwise applied to the chains by variable weight signatures on the bucket to maintain uniform tension on the chains. Circular cams move the free ends of the tines increasingly faster to orient the signature stack horizontally before the bucket withdraws from beneath the batch. Oscillating paddles jog the sides and corners of the signatures during stacking to form a neat batch. A turntable is rotated 180° after receiving each signature batch. Chain driven pusher rods mounted independently of the rotatable turntable pass through a gap in the turntable to remove the stack. The microprocessor initiates movement of the turntable and pusher rods an adjustable delay after delivery of each signature batch as a function of free fall time of each signature batch. Position sensors indicate bucket position. A top of batch sensor measures signature and batch thickness. A turntable sensor prevents erroneous operation of the pusher rods.

18 Claims, 20 Drawing Sheets

FIG.2c
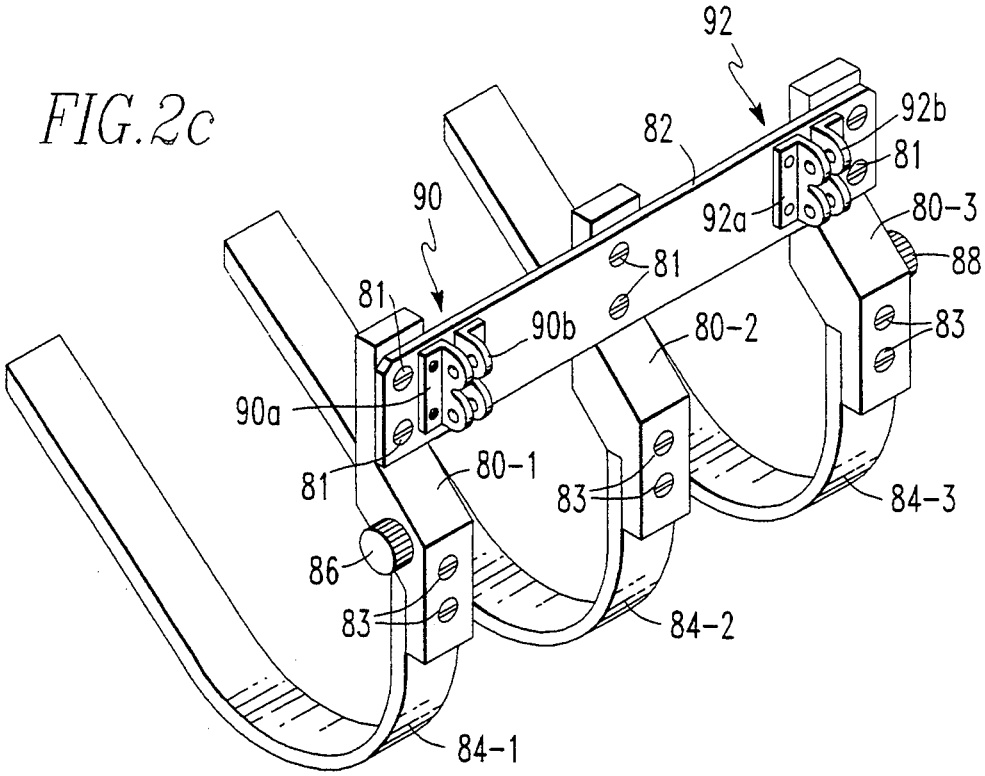
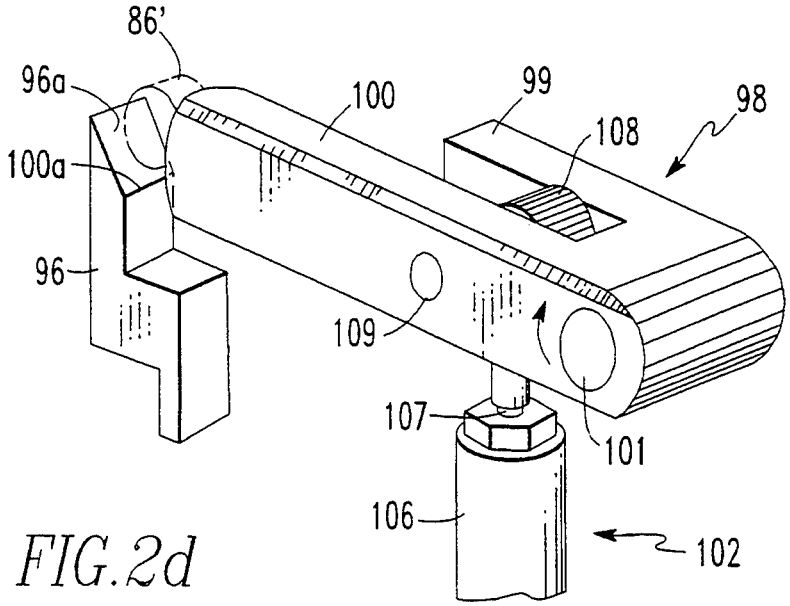
FIG.2d

FIG. 2i
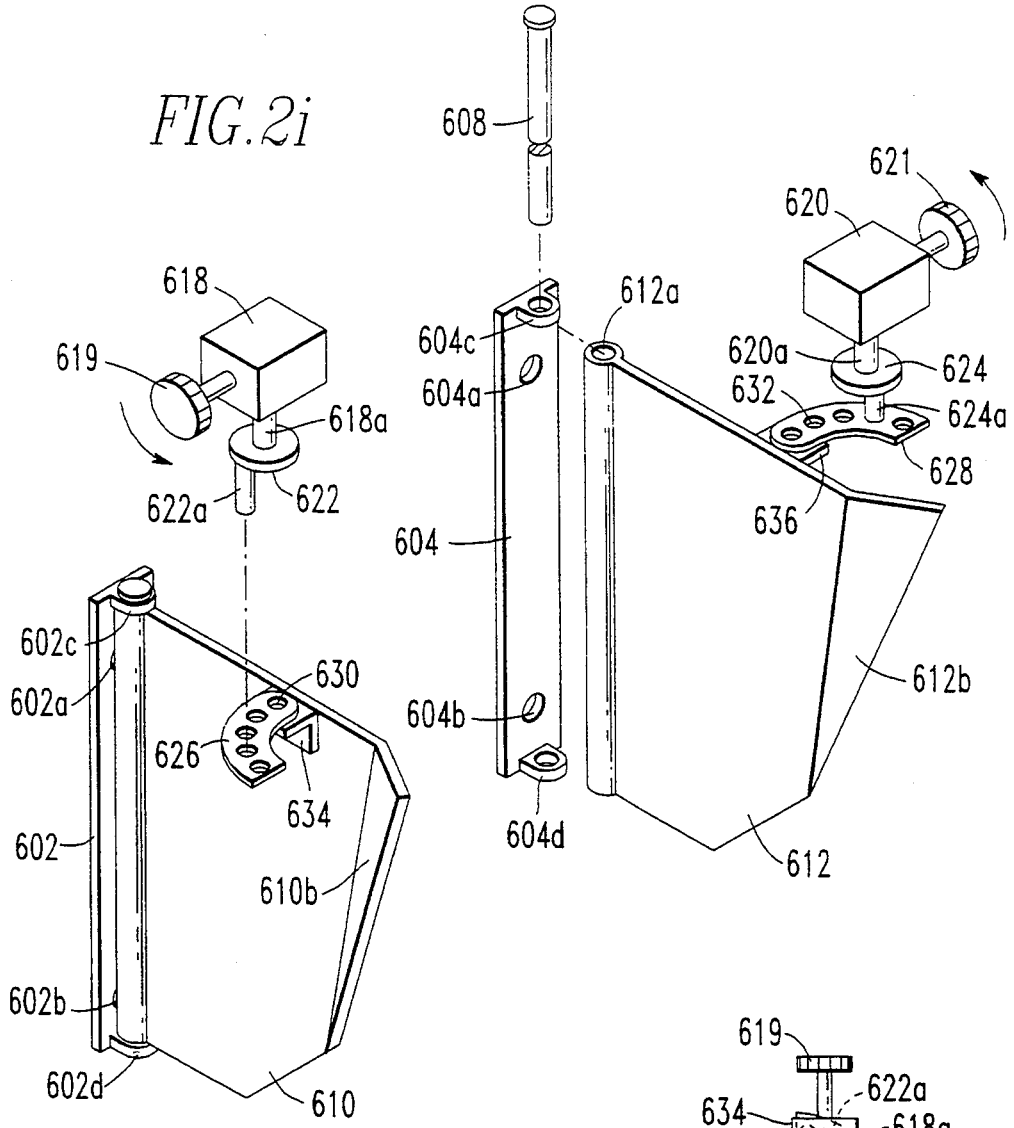
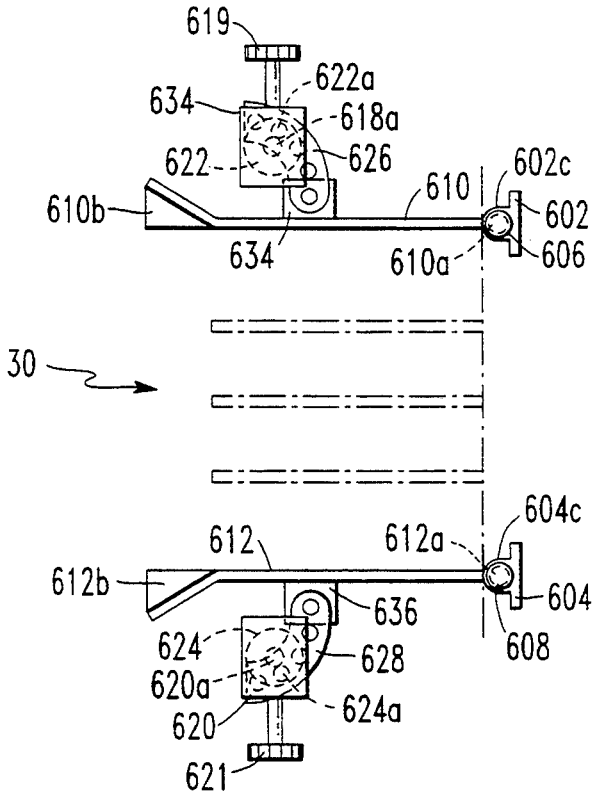
FIG. 2j

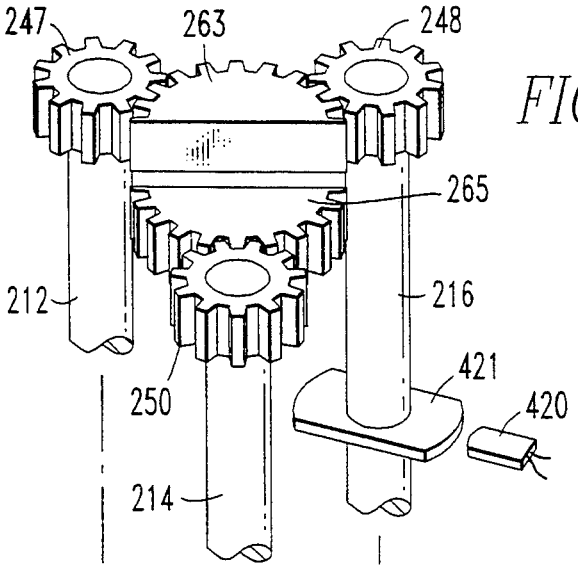
FIG. 3c
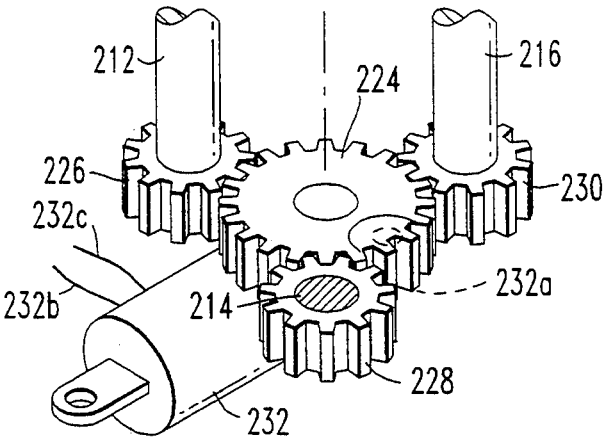
FIG. 3d
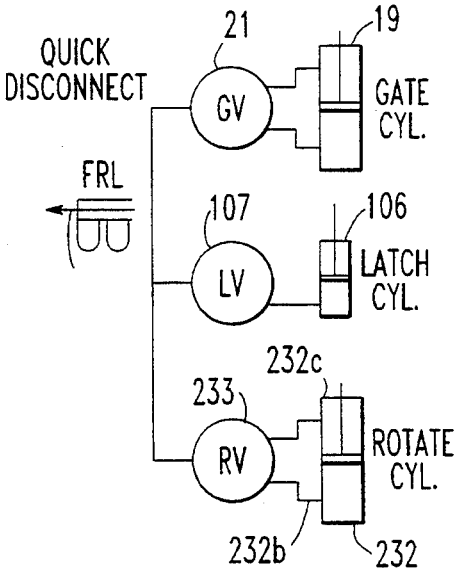
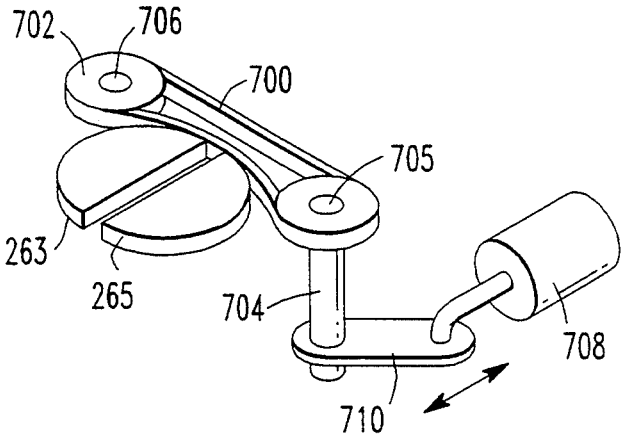
FIG. 3c-1

SIGNATURE STACKER

This application is a continuation of application Ser. No. 07/410,013, filed Sep. 19, 1989, now abandoned, which is a continuation of application Ser. No. 07/303,056, filed Jan. 27, 1989, now abandoned, which is a continuation of application Ser. No. 06/595,239, filed Apr. 2, 1984, now abandoned.

FIELD OF THE INVENTION

The present invention relates to a novel signature stacker for providing uniform and accurate counting and stacking of signatures through use of a bucket drive of simplified design and for providing a novel turntable cooperating with independent non-rotating pusher means for forming compensated stacks.

BACKGROUND OF THE INVENTION

Signature batches are typically formed by moving a bucket into a signature stream to intercept and collect signatures thereon until a batch of the desired number of signatures have been collected, at which time another bucket is moved into the signature stream and begins the signature collection anew.

The batch of signatures collected upon each bucket is delivered to a turntable. Since the thickness of the signature is greater along its folded edge, it is typical to form compensated stacks of signatures each comprised of a plurality of signature groups called batches, with the folded edges of the signatures in each batch displaced by 180° relative to the folded edges of the signatures in the adjacent batch, to compensate for the uneven stack height otherwise encountered in uncompensated stacks.

A compensated stack is formed by delivering one or more batches, each having a predetermined count of signatures, to the stacker turntable. After delivery of the first batch and prior to the delivery of the next batch, the turntable is rotated through an angle of 180° in readiness for receipt of the next batch. This operation continues until the desired number of batches have been delivered to the turntable, at which time a pusher rod is activated to remove the completed compensated stack from the turntable and to deliver the stack to a cooperating conveyor for subsequent handling. The turntable need not be rotated after the compensated stack is removed from the turntable.

The signature stream typically enters into the signature stacker with the signatures arranged in overlapping fashion, folded edges forward. A sensor of either mechanical or optical type senses incoming signatures typically by detection of the folded edge. A count signal developed by the sensor is applied to a counter, which counts the signatures sensed by the sensor.

Each one of a plurality of chain driven buckets is selectively consecutively latched in the "home" position in readiness for an intercept operation. The bucket is typically sprint-mounted to the chains and the spring is charged when the bucket is latched in the "home" position. On reaching a predetermined count, the bucket latched in the "home" position is unlatched whereupon the forces of the charged springs rapidly urge the tines of the bucket into the signature stream, causing signatures to be collected upon the bucket released from the "home" position.

As signatures are collected on the bucket, the bucket moves downwardly and ultimately drops out from beneath the completed batch of signatures allowing the batch of signatures to fall upon the turntable.

A pair of upright side walls extend from opposite sides of the rotatable turntable to aid in the formation of a neat stack.

When the compensated stack comprised of one or more individual batches is completed, the stack is removed from the turntable of one conventional apparatus by one of two pusher rods arranged at opposite ends of a chain drive arranged beneath the stacker platform. The stacker platform is comprised of two platform halves spaced apart by a clearance gap through which the pusher bar moves to discharge the compensated stack from the turntable and on to a cooperating conveyor. The push rod and push rod drive assembly rotate in unison with the stacker turntable requiring large forces for both accelerating and decelerating the turntable and push rod assemblies and their rotation and discharge mechanisms.

BRIEF DESCRIPTION OF THE INVENTION

The present invention is characterized by providing a stacker apparatus including intercept, turntable and discharge mechanisms which are distinguished by their simplified design, yielding rugged, reliable service.

The bucket advancing assembly comprises a pair of chains each entrained about a pair of drive sprockets and a pair of driven sprockets. The drive sprockets are rotated about a first common shaft rotated about a stationary axis and driven by a drive motor. The driven sprockets rotate about a second linearly movable shaft. A spring assembly normally urges the second linearly movable shaft downwardly and away from the first shaft to maintain the bucket chains under the desired amount of tension.

Each bucket is provided with cam follower rollers which engage cams arranged at the upper end of the bucket path to urge the bucket and hence the chain outwardly and away from the drive sprockets as the bucket moves about the drive sprockets towards the "home" position, urging the driven sprockets and linearly movable second shaft upwardly toward the first shaft and against the biasing force of the spring assembly, charging these springs and thereby applying a biasing force upon the last-mentioned bucket through the drive chains when the bucket is latched in the "home" position.

The cam follower rollers are latched in the "home" position between a stationary angle arm and a cooperating swingable piston-driven latch, which is initially positioned next to the angle arm and is driven away from the angle arm and the cam follower roller at the proper moment to enable the unlatched bucket to move downwardly and inwardly in a rapid fashion, in order to move into the signature stream and thereby terminate the flow of signatures to the bucket previously collecting signatures and cause signatures to be collected by the bucket just released from the "home" position.

The springs provide detent energy to hold the bucket in the latched position. When the bucket reaches the intercept position, the springs relax somewhat. If the latched bucket attempts to displace itself from the intercept position, this tends to cause the springs to re-compress. However, the bucket displacement cannot overcome the present spring force thereby retaining the bucket in the intercept position.

Certain prior art structures utilize a spring loaded shaft to maintain the chain tension required to move and support the buckets during stacking and to compensate for chain wear. Such prior art structures also require additional mechanisms, usually incorporating additional springs, to provide detent energy and to provide intercept energy.

The present invention incorporates a design which accomplishes all of the above functions while eliminating all such additional mechanisms. Thus one spring action compensates for chain wear, maintains proper tension for moving and supporting the buckets, providing the requisite detent energy and providing intercept energy.

The upper cam assembly includes a travel limiting plate which lies in the path of the bucket cam follower and is adjustable to adjust the position occupied by the free ends of the bucket tines when they move into the signature stream at the time the cam follower strikes the travel limiting plate.

The drive chains driven by the stacker motor advance the bucket receiving signatures after a predetermined delay, causing it to move off of the travel limiting plate and thereafter move downwardly along a substantially linear path toward the driven sprockets.

The bucket rotates from an inclined orientation supporting the signature batch toward a non-supporting withdrawn position at an angular velocity which initially allows the higher edge of the signature batch to catch up with the lower edge, assuring that the signature batch is aligned substantially horizontally as it moves through the free-fall region after having been released from the bucket and until it is deposited upon the stacker turntable, or upon the last signature stack previously deposited upon the stacker turntable.

Zero-force cams are positioned adjacent to the path of the downwardly moving bucket, and are each engaged by the cam follower of a bucket receiving and collecting signatures at about the same time that the next bucket coupled to the drive chains approaches the "home" position. The zero-force cams exert a force upon the engaging bucket to substantially eliminate the effect of a variable batch weight, which the bucket presently receiving signatures may otherwise exert upon the pulling tension of the drive chain to thereby prevent any deviation of the release force exerted upon the bucket now approaching the "home" position, due to the number of signatures deposited on the bucket. In the absence of the zero-force cams, a larger (i.e., heavier) batch will cause greater chain tension and more intercept energy and, therefore, a quicker intercept motion than would occur with a smaller batch. The zero-force cams thus assure exertion of a uniform intercept energy upon the bucket released from the "home" position, regardless of the batch size (and, therefore, the batch weight) of the bucket presently collecting signatures.

As signatures are collected upon a bucket, oscillating paddles, which are driven by the stacker motor, jog the sides and back edges of both the accumulating and collected signatures to move the signatures into proper alignment, thereby assuring the formation of a neat batch on each bucket. The paddles are reciprocated at a constant rate or at a rate related to the flow rate of signatures entering the stacker infeed section. The paddles are driven by the principal drive motor preferably through a gear box.

A timing gear is mounted upon the bucket drive shaft and a cooperating sensor senses rotation of the timing gear to generate pulses utilized by a microprocessor-based controller to precisely track the movement of each bucket and cooperates, together with a home switch which senses the "home" position of each bucket, to precisely monitor the position of each bucket as it moves downwardly from the "home" position towards the drop-out position.

The drive shaft driving the bucket chains is selectively coupled to the stacker drive motor through an electromagnetic clutch. An electromagnetic brake is coupled to the opposite end of the drive shaft and cooperates with the clutch to enable the buckets to be abruptly halted and restarted.

The controller utilizes these components for assuring the neat stacking of the proper number of signatures upon each bucket. More specifically, after intercept, there is a brief pause in the drive imparted to the bucket chain, enabling the last signature to be properly deposited on the previous bucket receiving signatures.

Depending upon the height of a batch, which is a function of paper thickness, the number of sheets per signature, the number of signatures, and signature feed rate, the controller operates the bucket receiving signatures to pause preferably at two or more staring locations along its downward movement, typically halfway between intercept and drop-out and three-quarters of the way between intercept and drop-out. The controller examines the signature count at each staging position of the bucket to assure that one-half of the signatures in the desired batch and three-quarters of the signatures in the desired batch have been counted by the signature counter when the bucket reaches the half and three-quarter staging locations, respectively. The time interval that a bucket is held in the staging position is variable in length and is a function of signature thickness, signature feed rate and other variables and is utilized to assure proper, neat stacking of signatures on the downwardly moving bucket. For example, if one-half of the signatures of a batch have been counted when the bucket reaches the half-way staging point, there will be no delay. Conversely, the delay will be increased as a function of the number of signatures yet to be counted to complete the one-half batch count.

Staging may be accomplished either by synchronizing positions of the stacker section with coordinated status of the signature count or by synchronizing increments of stacker motion with coordinated paper count increments.

The turntable assembly in the preferred embodiment comprises a split turntable in which the turntable halves are spaced apart to form a center gap and are each provided with gear sections formed from a split gear, which gear sections are selectively driven by at least three upper planetary gears arranged at spaced intervals and which in turn are driven by three associated lower planetary gears engaged by a common sun gear which in turn is rotated by means of an air-driven piston assembly.

The lower planetary gears may be driven by a chain or belt. The upper planetary gears may also be driven by a chain or belt. Alternatively, the upper split gear may be driven by a chain or belt engaging the split gear. The chain or belt may be entrained about a pair of gears or pulleys, one of which is driven.

Each of the turntable halves of the split turntable is rollingly supported by a plurality of carrier rollers arranged at spaced intervals along a curved mounting member, said carrier rollers being rollingly received by a stationary, circular split carrier track comprised of track halves arranged on opposite sides of a center gap. The gear sections are selectively engaged by the three aforementioned upper planetary gears causing the turntable halves to move from one track to the other thereby "rotating" the turntable and hence the signature stack thereon through an angle of 180°. The tracks distribute the weight of the turntable over a large area, reducing the local forces exerted upon the supporting track.

A stationary mounting positioned beneath the movable turntable halves supports a drive sprocket mounted upon a common shaft and three driven sprockets mounted to rotate about a common axis parallel to said common shaft. A first chain is entrained about one of the drive and one of the driven sprockets, and a second chain is entrained about the remaining driven sprockets. A pair of push rods arranged at equi-spaced intervals on said chains are each movable through the gap between the turntable halves to push a stack off of the turntable, out of the stacker and on to a conveyor for subsequent handling. The pusher assembly is mounted independently of the turntable and is mounted upon a stationary structure, significantly reducing the mass of the turntable movable members and the components which rotate with the turntable. Sensor means cooperating with one of the planetary gears is utilized to assure that the turntable is in the proper position before the pusher rod is moved. The turntable center gap is centrally located and the pusher rods move along its center line to assure ejection of a bundle without skewing the bundle as it leaves the turntable.

The adjacent ends of the split turntable halves forming said gap are curved, forming an enlarged gap entry area to provide adequate clearance for the pusher rods as they enter said gap, and thereby allow for some displacement of the turntable halves from their desired position, without interfering with the movement of the pusher rods through said gap.

The turntable side walls, which engage the signatures along opposite parallel sides, may be provided with spring loaded gates to prevent linear movement of signatures in a direction parallel to the sidewalls during rotation of the turntable.

Anti-backlash assemblies each exert a force on the turntable drive train to take up any clearances between the gear teeth and the drive train. The anti-backlash assemblies also absorb the impact energy developed when the turntable is halted and further provide some starting energy. Pusher rod gates arranged between the turntable halves maintain proper orientation and positioning of the turntable halves relative to one another, and assure that the forces moving the turntable halves are substantially equally balanced.

The microprocessor-based controller is utilized to initiate movement of the pusher rod or turntable as a function of drop distance required of the last signature batch delivered to the rod of previous batches on the turntable, in order to initiate movement of the pusher rod or turntable at an earlier point in time as the drop distance decreases.

The timing gear and a top of batch sensor are employed for determining batch thickness and individual signature thickness by moving the bucket containing a completed signature batch upward to a point below the top of batch sensor and then backing off from that position to provide a thickness measurement when the top of batch sensor is released by counting the number of pulses developed by the timing gear, converting the count to a distance value, based on the knowledge of the distance moved per pulse to determine batch size and with knowledge of the signature count dividing the distance by the signature count to obtain the individual signature thickness.

OBJECTS OF THE INVENTION AND BRIEF DESCRIPTION OF THE FIGURES

It is, therefore, one object of the present invention to provide a novel stacker section for forming neat signature stacks of a precise count and for delivering said stacks to a stacker platform, said stacker section utilizing a spring biased movable sprocket assembly which provides the functions of maintaining optimum tension upon the drive chains of the stacker section, assuring positive detent action and drop-out of the chain-driven buckets and providing a consistent uniform acceleration force for rapidly moving each bucket from the "home" position into the intercept position for intercepting and receiving a signature stream.

Another object of the present invention is to provide a novel stacker section for signature stackers and the like, having cam means for moving the bucket and stacker drive chains outwardly and away from the normal chain path to charge a set of springs and means for latching the bucket in the home position and maintaining the springs charged preparatory to release of the bucket for abruptly intercepting the signature stream.

Still another object of the present invention is to provide a stacker section having means for adjusting the intercept position of a bucket as it is released from the "home" position.

Still another object of the present invention is to provide a novel stacker section for use in signature stackers and the like having simplified and reliable means for orienting a signature stack for a controlled free-fall delivery of the signature stack from the inclined stacker section to the horizontal turntable.

Still another object of the present invention is to provide a novel stacker section for use in signature stackers and the like having cooperating cam and cam follower means for counteracting the weight of a stack of signatures upon a bucket to assure that the force imparted to each bucket about to be unlatched from the "home" position is consistent and uniform.

Still another object of the present invention is to provide a novel stacker section for use in signature stackers and the like including a microprocessor-based controller for providing variable length pauses during the movement of a stacking bucket at predetermined stages as the bucket moves from the "home" position to the drop-out position for assuring optimal delivery of the signatures to each bucket, thus assuring the formation of a neatly stacked batch.

Still another object of the present invention is to provide a novel turntable assembly for use in forming compensated signature stacks in signature stackers and the like, comprising a rotatable split turntable and a push rod assembly, each independently mounted upon a common frame, wherein the rollingly mounted split turntable assembly moves independently of said push rod assembly.

Still another object of the present invention is to provide a novel turntable assembly for use in forming compensated signature stacks in signature stackers and the like and comprising split turntable halves each incorporating a split gear rotatable by synchronouslydriven planetary gears for causing the platform halves to rotate after receipt of a signature stack.

Still another object of the present invention is to provide a stacker turntable comprised of rollingly mounted turntable halves for distributing the weight of the platform halves over a large area and thereby providing a sturdy, reliable support.

Still another object of the present invention is to provide novel turntable means for use in forming compensated stacks in signature stackers and the like and including controller means for initiating operation of the turntable and/or push rod assembly as a function of the drop distance of a batch delivered from the stacker section of the turntable.

Still another object of the present invention is to provide novel control means for use in a signature stacker for forming compensated stacks including method and apparatus for controlling the signature stacker to form neat batches.

The above, as well as other objects of the present invention, will become apparent when reading the accompanying description and drawing in which:

FIG. 1*a* shows a side elevation of a signature stacker embodying the principles of the present invention.

FIG. 1*b* shows a front elevation of the signature stacker of FIG. 1*a* with a portion of the stacker removed to show the infeed and turntable assemblies.

FIG. 2 is a side elevation of the upper part of the signature stacker showing the stacker section and input conveyor in greater detail.

FIG. 2*a* shows a side elevation of the stacker section.

FIG. 2*b* is a rear elevation of the stacker section of FIG. 2*a*.

FIG. 2*c* is a detailed perspective view of one of the bucket assemblies shown in FIG. 2*a*.

FIG. 2*d* is a perspective view of the latch assembly shown in FIG. 2*a*.

FIG. 2*e* is a side elevational view of the latch assembly forming part of the stacker section of FIG. 2*a* and showing the latched and unlatched positions.

FIG. 2*f* is a plan view of an upper sprocket in the stacker section of FIG. 2*a*.

FIG. 2*g* is a perspective view of a paddle assembly.

FIG. 2*h* is a top view of the paddle assembly of FIG. 2*g*.

FIG. 2*h*-1 is an enlarged view of a portion of FIG. 2*h*.

FIGS. 2*i* and 2*j* show perspective and top views of an alternative paddle assembly.

FIG. 3*a* is an elevational view showing the turntable assembly of FIGS. 1*a* and 1*b* in greater detail.

FIG. 3*b* shows a top plan view of the turntable assembly of FIG. 3*a*.

FIG. 3*c* shows a detailed perspective view of the gear train for rotating the turntable halves.

FIG. 3*c*-1 shows an alternative drive arrangement for the turntable.

FIG. 3*d* shows a pneumatic circuit for operation of the turntable assembly of FIGS. 2*a* and 3*b*; the drop-out latch of FIG. 1*a*; and the latch mechanism of FIG. 2*d*.

FIGS. 3*e* and 3*f* show the anti-backlash assembly forming part of the turntable assembly of FIG. 3*a*.

FIGS. 3*g* and 3*h* respectively show detailed top plan and side elevational views of the stationary supports for the turntable assembly of FIG. 3*a*, and which are also shown in FIG. 1*a*.

FIG. 3*i* shows a detailed plan view of the turntable halves of FIG. 3*c*.

FIG. 3*j* is a sectional view of the turntable halves looking in the direction of arrows 3*j*—3*j* of FIG. 3*i*.

FIG. 3*k* is a detailed view of the brush assemblies employed in the turntable of FIG. 3*i*.

FIG. 3*l* is a detailed view showing the latch gates employed in the turntable assembly of FIG. 3*a*.

FIG. 4*a* shows a simplified diagram of the microprocessor-based controller for operating the apparatus of FIG. 1*a*.

FIG. 4*b* is an elevational view showing bucket movement through the stacking region and which aids in understanding the staging routine.

FIGS. 4*c* and 4*d* show flow diagrams of the functions performed by the microprocessor-based controller of FIG. 4*a*.

DETAILED DESCRIPTION OF THE INVENTION

Figure 1A:
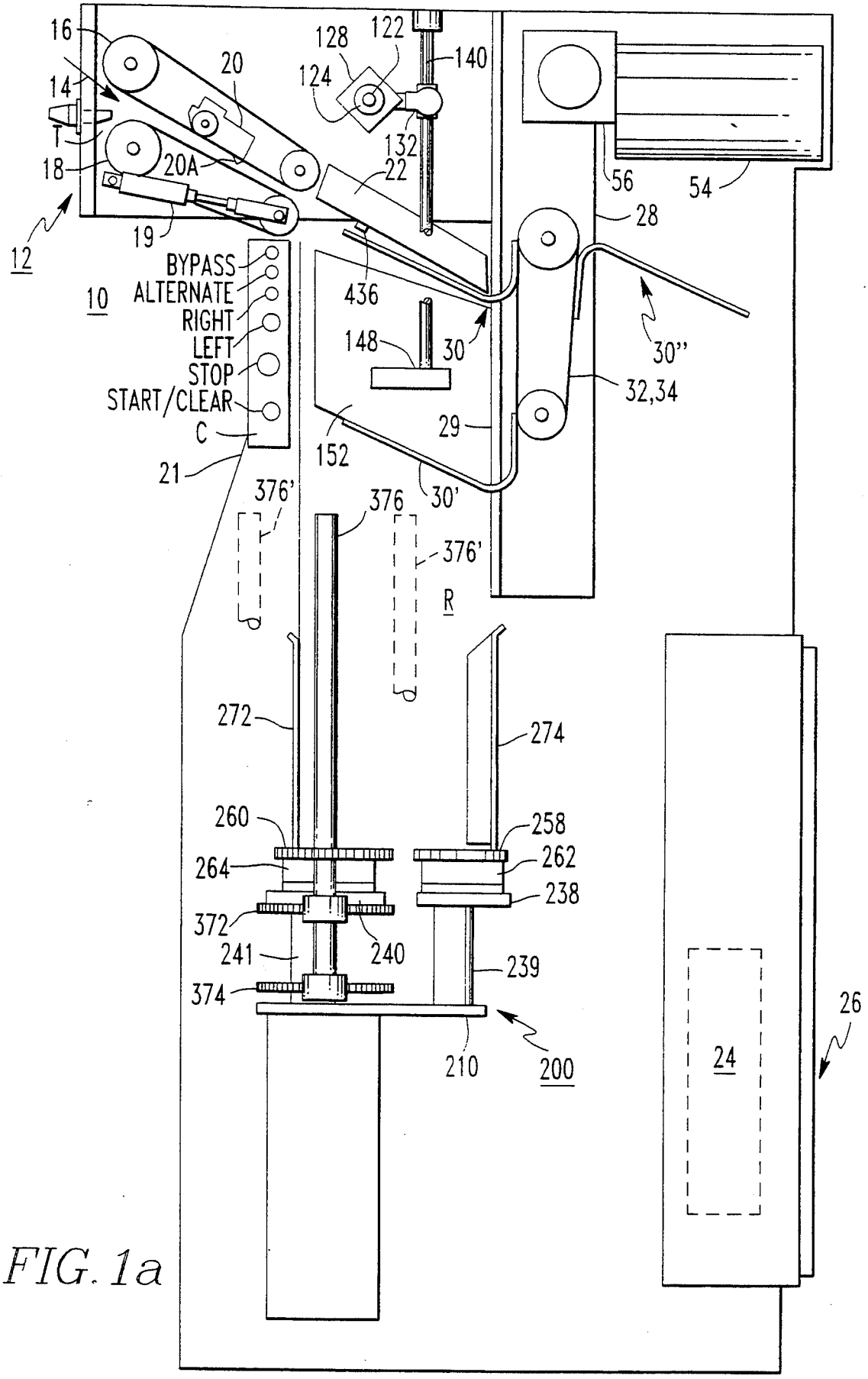
Figure 1B:
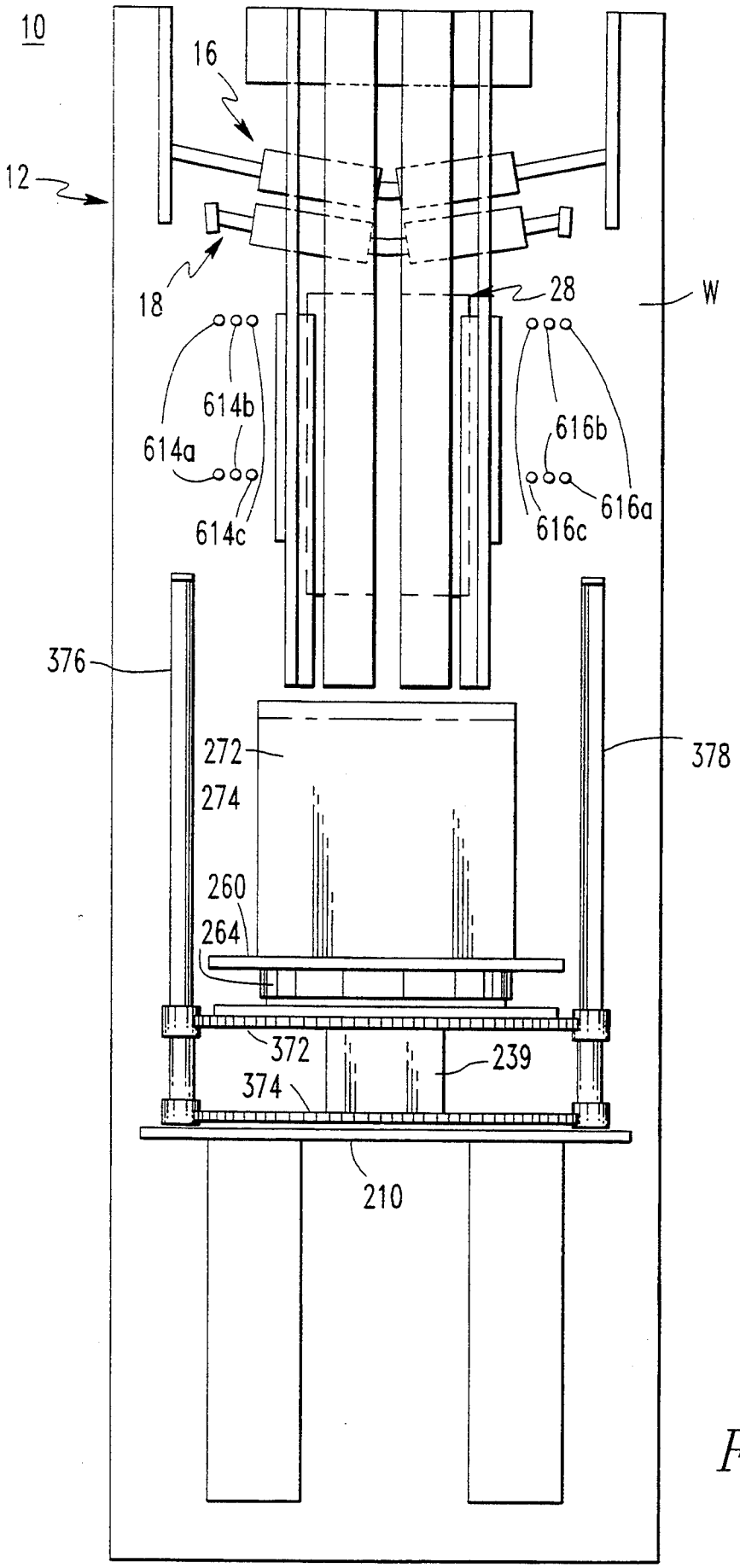

FIGS. 1*a* and 1*b* show a stacker 10 embodying the principles of the present invention and comprised of an input section 12 receiving a signature stream moving in the direction of arrow 14 which enters input section 12, moving between closed-loop conveyor belt assemblies 16 and 18 which form a tapering entry throat T for receiving the signature stream.

A sensor 20, which may be of the type described in U.S. Pat. No. 3,702,925 issued Nov. 14, 1972, is arranged in the position shown so that its sensing member 20*a* is engaged by the folded forward edge of each signature to develop counting pulses which are coupled by cable means (not shown) to the controller 24 arranged within a compartment 26 in stacker 10 for control purposes, as will be more fully described.

A guide 22 guides the signatures as they leave the outfeed end of conveyor assemblies 16 and 18 and move toward a bucket assembly 30, to be more fully described. A speed sensor 23 senses teeth of gear 25 rotating under control of chain 57 (see FIG. 2) to develop pulses. These pulses represent motion of the signatures and are delivered to the microprocessor to determine the actual linear speed of signatures delivered by the infeed section to the stacking section and the speed of movement of the signatures. The sensor need not be employed in a constant speed stacker.

A plurality of bucket assemblies 30 are mounted at spaced intervals along a pair of closed loop drive chains 32 and 34. In the preferred embodiment, the drive chains 32, 34 support three buckets 30, 30' and 30'', arranged at spaced intervals therealong.

Figure 2:
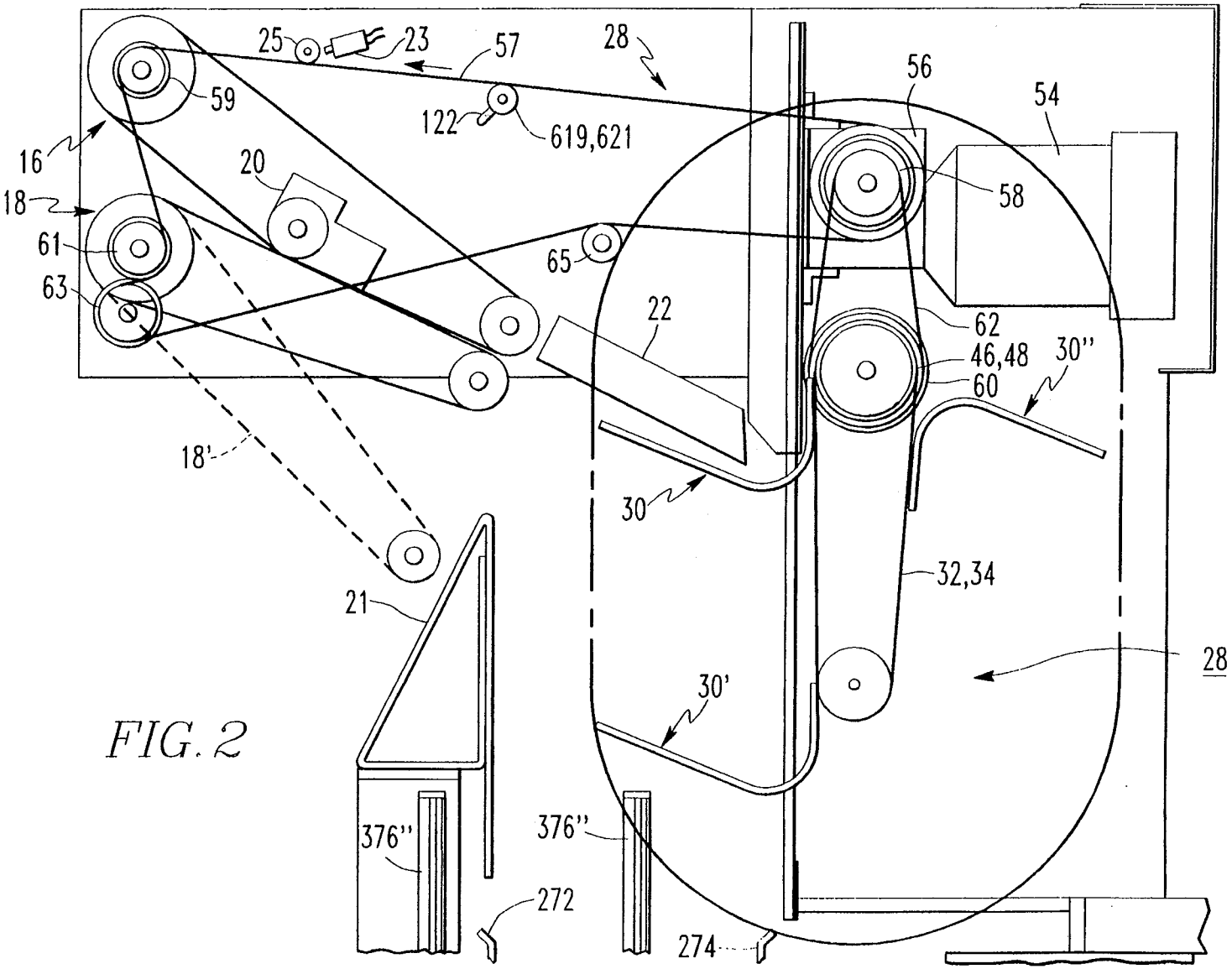
Figure 2A:
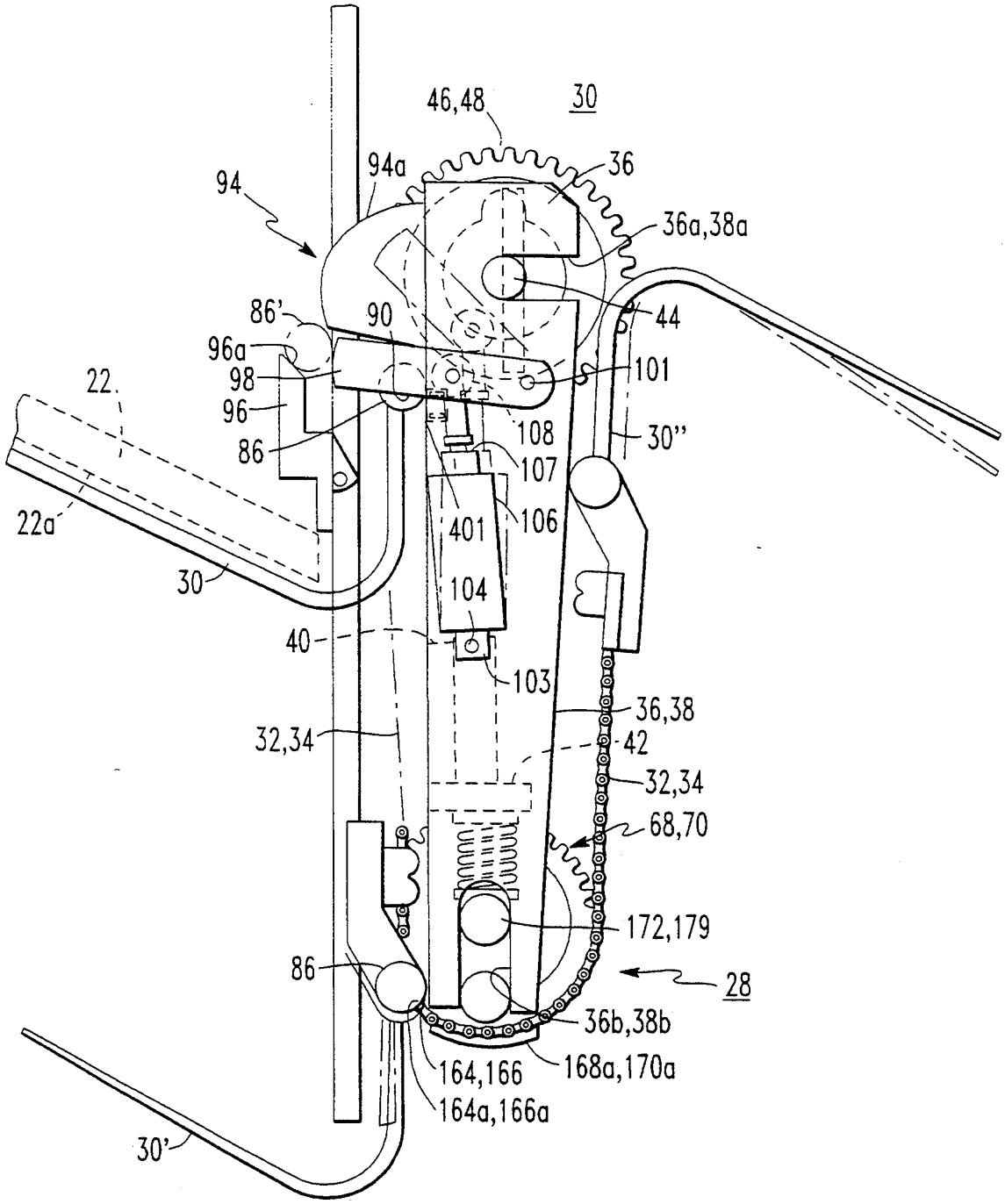
Figure 2B:
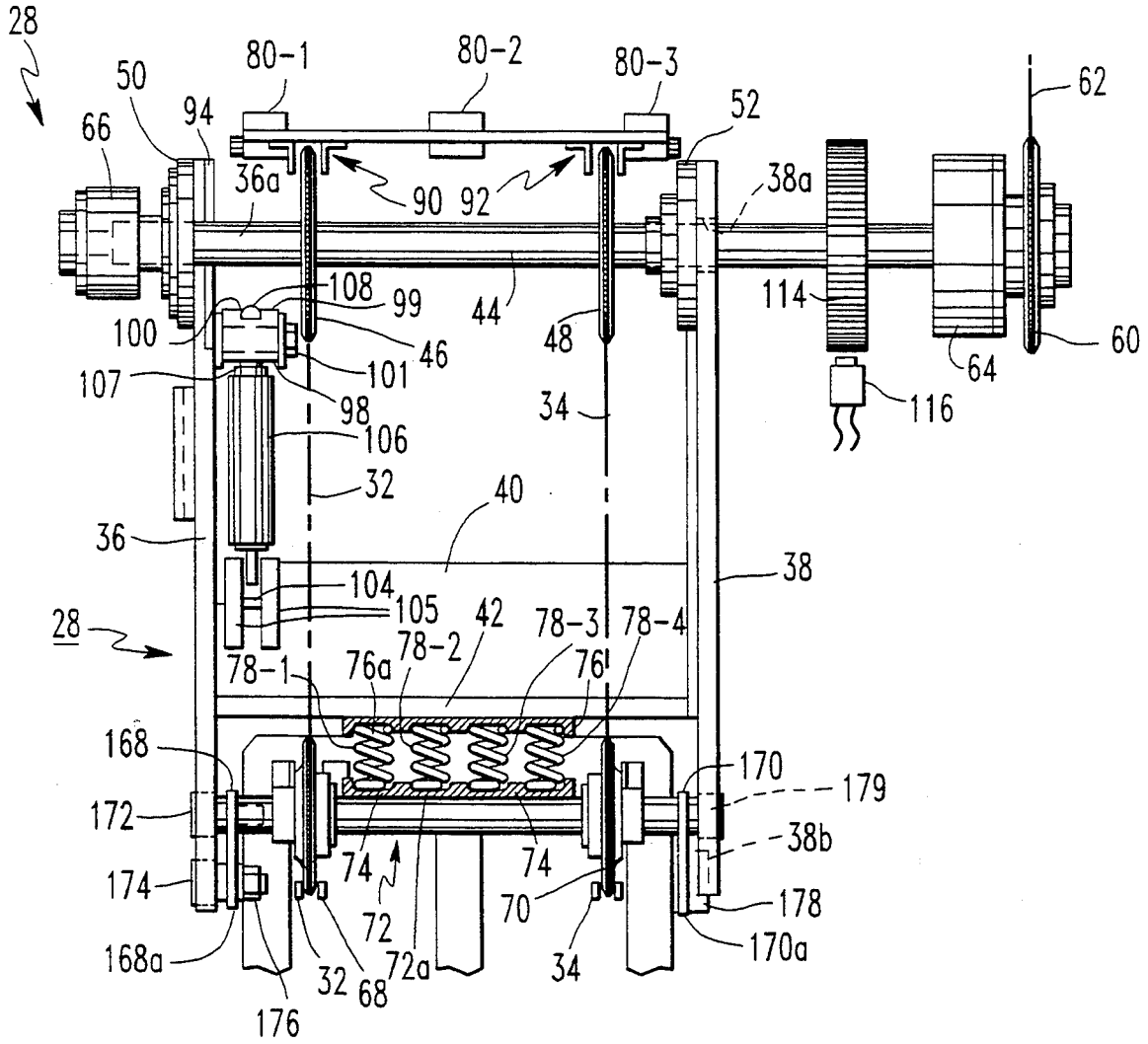

Noting also FIGS. 2, 2*a* and 2*b*, which show the batch forming (i.e. stacking) section 28 of the stacker in greater detail, it can be seen that the batch forming section 28 is comprised of a pair of plates 36, 38 maintained in spaced parallel fashion by means of spacer plates 40 and 42 secured to plates 36, 38.

The upper ends of side plates 36 and 38 (FIGS. 2*a*, 2*b*) are each provided with elongated horizontally aligned slots 36*a*, 38*a* for receiving a drive shaft 44 carrying sprockets 46 and 48 for driving chains 32 and 34 respectively. Shaft 44 is freewheelingly mounted in bearings 50 and 52 secured to plates 36 and 38 respectively.

Stacker 10 is provided with a drive motor 54 (FIG. 2), whose output is coupled to gear reducing means 56. A drive sprocket 58 couples drive to a driven sprocket 60 through drive chain 62. Electromagnetic clutch 64 selectively couples shaft 44 to driven sprocket 60 under control of the microprocessor-based controller 24 housed in compartment 26. An electromagnetic brake 66, also under control of controller 24, provides means for abruptly halting the chains 32 and 34 and hence the buckets 30.

Lower sprockets 68 and 70 are mounted upon shaft 72 which is slidably mounted within the downwardly facing slots 36*b*, 38*b* in each of the side plates 36 and 38.

Shaft 72 (FIG. 2*b*) is generally cylindrical and is provided with a flat surface 72*a* supporting a rectangular-shaped plate 74 secured thereto. A similar plate 76 is secured to the underside of cross piece 42. Plates 74 and 76 are each provided with a plurality of circular-shaped recesses 74*a*, 76*a*, arranged in cooperating fashion as shown best in FIG. 2*b*, for the purpose of receiving and supporting the opposing ends of helical springs 78-1 through 78-4, which springs normally urge movably mounted shaft 72 downwardly and away from plate 42 and hence away from shaft 44 to maintain the drive chains 32 and 34 under proper tension, as well as providing a plurality of other functions as will become apparent hereinbelow.

Each of the bucket assemblies 30 is identical in design and operation and, for purposes of simplicity, a description of one typical bucket assembly 30 as shown in FIG. 2*c* will be described in detail. Bucket 30 is comprised of three substantially Z-shaped truck pieces 80-1 through 80-3, each having their upper ends secured to a truck bar 82 by fasteners 81 and their lower ends secured to a curved bucket tine 84-1 through 84-3, respectively, by fasteners 83. Rotatable cam follower rollers 86 and 88 are freewheelingly mounted along the outer surfaces of truck pieces 80-1 and 80-3, respectively. The cam follower rollers 86 and 88 cooperate with cams and latching means, to be more fully described, for controlling the movement of the bucket assemblies 30.

Each bucket assembly 30 is fixedly and non-rotatably linked to drive chains 32 and 34 by means of the coupling bracket assemblies 90 and 92, each comprised of first and second L-shaped bracket members 90*a*, 90*b*, and 92*a*, 92*b*, respectively, the first arm of each bracket member being fixedly secured to truck bar 82 while the remaining arm of each bracket member extends outwardly and away from the mounting surface of truck bar 82, and is provided with openings for receiving connecting pins (not shown) forming part of the drive chains 32, 34 to serve the dual function of pivotally coupling and linking adjacent links of the chain, as well as joining each bucket 30 to the chains 32 and 34.

FIGS. 1*a*, 2 and 2*a* show the three buckets 30, 30′ and 30″ arranged at equally spaced intervals about the drive chains 32 and 34. FIG. 2*a* shows bucket 30 in the position just after intercept from the "home" position to be more fully described. When a bucket reaches the position occupied by bucket 30′, it has received substantially all the signatures to complete a batch and is ready to withdraw from beneath the completed signature batch as it moves around the lower end of the drive chain path and moves upwardly along the return path and toward the "home" position.

In the position 30″, a bucket has moved upwardly along the return path and is just below the upper end of the chain drive path. The bucket rotates through 180° in moving from position 30″ to position 30.

Figure 2F:
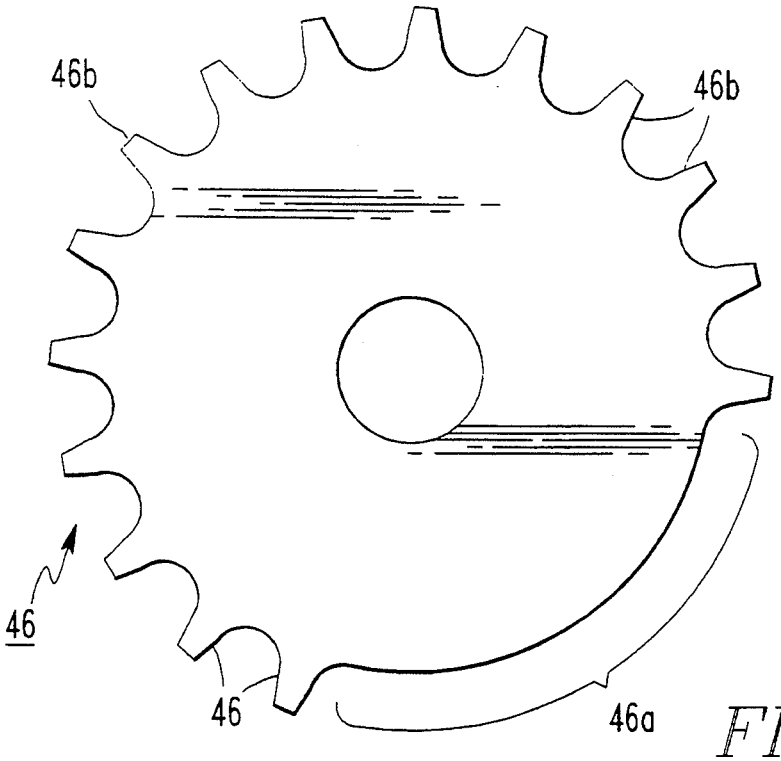
Figure 2E:
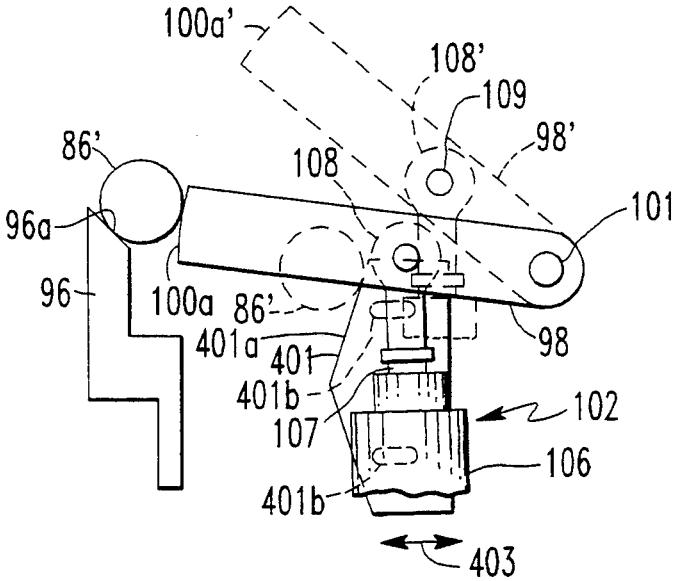

The cam follower rollers 86, 88 (FIGS. 2*a*, 2*c*) each cooperate with a cocking cam 94 secured to the upper end of support brackets 36 and 38. Cocking cam 94 has a cam surface 94*a* which urges roller 86 and hence the bucket 30 and a portion of chain 32 to be substantially radially displaced from sprocket 46. The movement of chain 32 away from sprocket 46 causes shaft 72 to move upwardly, charging springs 78-1 through 78-4. The charged springs 78-1 through 78-4 also provide a detent function to retain the cam follower 86 and hence the bucket 30 in the latched position. The cocking cam 94 reduces the rotation of the bucket to an angle of approximately 150°–155° in moving from the position 30″ to the "home" position. Cam follower roller 86, as it moves off the lower end of cam surface 94*a*, is latched into the home position represented by cam follower roller 86′ (FIG. 2*a*) wherein roller 86′ rests upon the inclined surface 96*a* of substantially Z-shaped latching member 96 and the curved free end 100*a* of swingably mounted latch lever 98 comprised of a pair of bifurcated arms 99 and 100, arm 100 being longer than arm 99 (see also FIG. 2*d*). The latch lever 98 is pivotally mounted to side plate 36 by pin 101. An air-driven piston assembly 102 has a lower stub 103 provided with an opening for receiving pin 104 which extends through stub 103 and has its opposite ends secured within a pair of piston assembly mounting brackets 105. The piston assembly 102 is comprised of a cylinder 106 containing a slidably mounted piston (not shown) secured to piston rod 107. An eyelet member 108 (FIG. 2*e*) is positioned between arms 99 and 100 and is secured to the free end of distort rod 107 and has a central opening for receiving a pin 109 whose opposite ends are secured within the arms 99 and 100 of latch lever 98.

The cam follower roller 86′ remains latched in the "home" position, until the time the desired number of signatures to be collected upon the bucket 30′ previously unlatched from the "home" position have been counted and advance to the same position. This is referred to as the intercept delay and is the time interval starting with the moment the first copy of the new batch is sensed by the product sensor until the moment the intercept latch is released. The piston assembly 102 is operated to swing latch lever 98 clockwise about pivot pin 101, moving the latch lever 98 upwardly from the solid line position 98 to the dotted line position 98′ shown in FIGS. 2*a* and 2*e*. Roller 86′ is thus released and rapidly moves diagonally downward along an arcuate path about upper connecting pins in bracket member 90 and 92 from the position 86′ to the position 86″ (FIGS. 2*a* and 2*e*), striking limit plate 401. The force applied to the unlatched bucket through chains by the charged springs 78-1 through 78-4 causes the free ends of tines 84-1 through 84-3 to rapidly move into the path of movement of the signature stream and to collect all subsequent signatures, and thereby prevent such signatures from being collected by the previously unlatched bucket 30′, limiting the number of signatures collected by the previously unlatched bucket to a predetermined amount. Thereafter, electromagnetic brake 66 is released and electromagnetic clutch 64 is engaged to rotate shaft 44 and move drive chains 32 and 34. The operation of brake 66 and clutch 64 is delayed for an interval of the order of several milliseconds or so under control of controller 24, to allow the last signature(s) to be collected to reach the moving bucket 30′. The delay is referred to as the drop delay and starts when the leading edge of the last signature of the batch reaches the back ribs 29 of the stacking section 28 (see FIG. 1*a*).

Since the cocking cam 94 causes cam follower rollers 86 and 88 (see FIG. 2*a*), and hence a portion of drive chains 32 and 34 to be moved away from sprockets 46 and 48 causing the chains 32, 34 to move at a rate different from the rate of movement of sprockets 46, 48, each sprocket is provided with an arcuate portion 46a (see FIG. 2f) which has been machined to remove all of the sprocket teeth which would otherwise be provided along the arcuate portion 46a, to permit drive chains 32 and 34 to experience sliding movement relative to sprockets 46 and 48, without causing damage to either drive chain 32 and 34 or the teeth 46b of sprockets 46 and 48. The arcuate portion 46a of sprocket 46 occupies the position shown by the bracket in FIG. 2a during the time that chain 32 is being moved away from sprocket 46, so that the first "missing" tooth of the arcuate portion 46a is aligned with the vertical line passing through the center of sprocket 46 to allow slippage between chain 32 and sprocket 46 (due to movement of chain 32 away from its normal path), without damaging either sprocket 46 or chain 32. The relationship of sprocket 48 and chain 34 is the same as that between sprocket 46 and chain 32.

Either one cocking cam 94, latch 98, latching member 96 may be employed in the embodiment described, or a pair of these elements may be employed for cooperating with each of the cam follower rollers 86 and 88. The latch arms 98 may be driven by a single piston 102 whose eyelet member 108 may be coupled to both latch arms by a long shaft replacing pin 109.

A timing gear 114 secured to shaft 44 cooperates with a sensor 116. Timing gear 114 has a predetermined number of teeth arranged around its periphery and cooperates with sensor 116 to generate pulses as shaft 44 rotates. These pulses are employed for control purposes as will be described hereinbelow.

The pulses developed by monitoring sensor 116 each represent an increment of travel of the drive chains 32 and 34 and hence the position of the unlatched bucket presently collecting signatures. When a first predetermined number of said pulses have been accumulated, for example, representing travel of the bucket halfway between the "home" position and the position occupied by the bucket when the next upstream bucket is unlatched from the "home" position, the controller 24 looks at the count of signatures which have passed the sensor 20 and if this count is less than an amount corresponding to one half the signatures, a delay is imparted to movement of the bucket (by releasing clutch 64 and engaging brake 66) until one-half of the desired total number of signatures have been counted, at which time the bucket is again rapidly moved downward. A similar staging operation is performed when the pulses developed by position sensor 116 indicate that the last bucket to be unlatched has moved three-quarters of the last aforementioned distance, at which time the controller examines the count developed by the signature counter to determine if an amount corresponding to three-quarters of the signatures have been counted. The length of the pause in movement of the bucket is a function of the difference between the number representing three-quarters of the count of completed stack of signatures and the actual number of signatures counted. Of course, if the number of signatures counted is equal to or greater than the count of one-half of a completed batch at the half-way position, no delay is provided. The same is true of the three-quarter staging position. These staging operations assure formation of a neat stack. If desired, the staging positions may be arranged at other locations, for example, 3/5 and 4/5 of the full travel distance, the counts to be reached at such times representing 3/5 and 4/5 of the completed stack. If desired, a greater or lesser number of staging operations may be performed (i.e., as few as one or three or more).

Figure 2H:
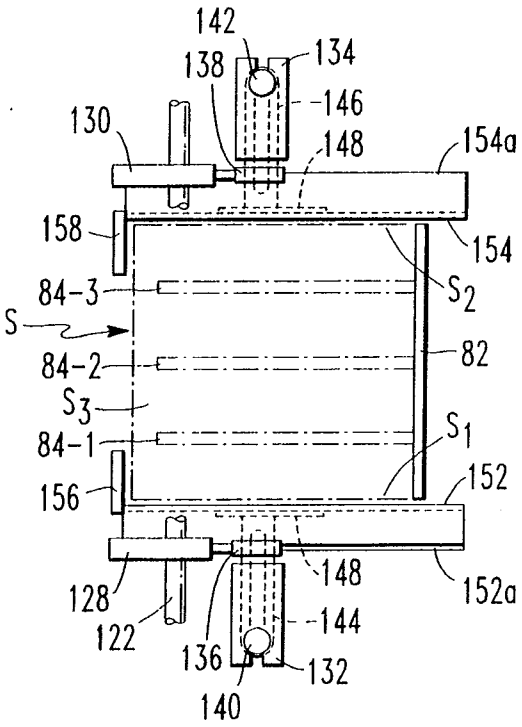
Figures 1, 2H:
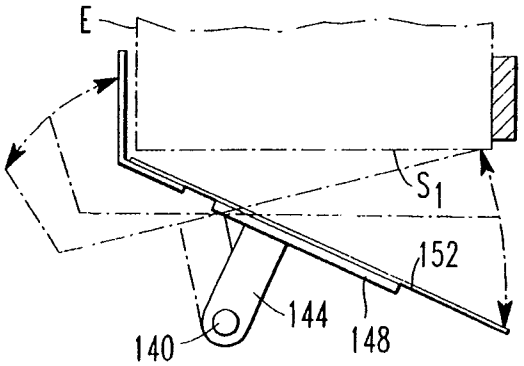
Figure 2G:
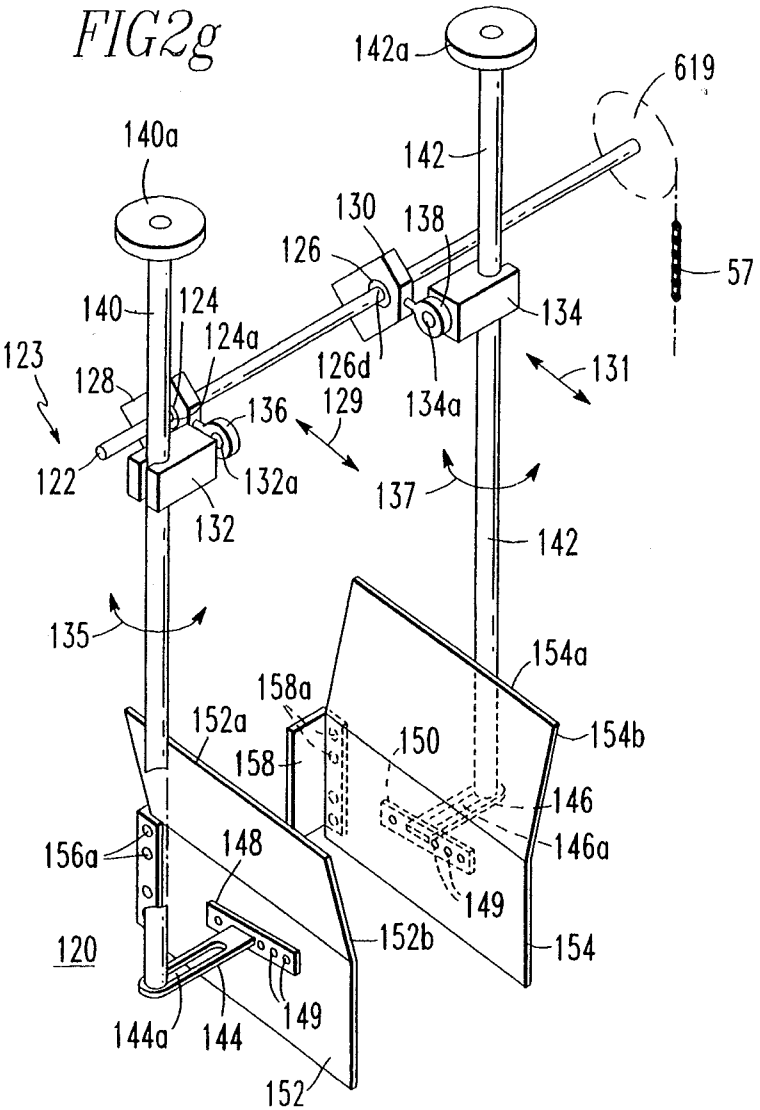

The neatness of a signature stack being formed is further enhanced through the use of paddle assembly 120, shown in FIGS. 2g, 2h and 2h-1, and comprised of horizontally aligned common drive shaft 122 rotatable about its longitudinal axis and extending through the eccentrically located openings 124a and 126a in rotatable members 124 and 126 mounted within the openings in diamond-shaped members 128 and 130, respectively. Depending on whether the stacker 10 is a fixed or variable speed stacker, shaft 122 has a constant r.p.m. or a variable r.p.m. and is mechanically coupled to the infeed section drive chain 57 (see FIG. 2) by means such as a gear 619 or a gear box (not shown) coupled between chain 57 and shaft 122.

Members 128 and 130 are pivotally connected to the stub shafts 132a, 134a of connecting members 132 and 134 by means of eyelet members 136 and 138. The outer ends of members 132 and 134 receive and are secured to vertically aligned elongated rods 140 and 142 mounted within suitable bearings 140a, 142a provided at their upper ends for enabling rotation of elongated rods 104, 142 about their longitudinal axes.

The lower ends of rods 140 and 142 extend into the elongated slots 144a, 146a of arms 144 and 146 whose free inward ends are joined to paddle supporting members 148, 150, each supporting a large sheet-like plate 152, 154 which serve as paddles, by means of fasteners 149. Plates 152 and 154 are bent at 152b, 154b to form upper ends 152a, 154a which extend upwardly and away from one another to form a tapering throat portion for guiding signatures from the signature stream to a bucket moving between paddles 152 and 154. A pair of L-shaped corner members 156, 158 are secured to the left-hand ends of paddles 152 and 154 relative to FIG. 2g.

Considering the top plan view of the paddle assembly shown in FIGS. 2h and 2h-1, paddles 152 and 154 each oscillate along an arcuate path about the axes of shafts 140 and 142. The shaft 122 and eccentrics 124 and 126 continuously rotate in one direction only, as shown by arrow 123. However, the eccentric members 124 and 126 convert this rotation movement into reciprocating movement imparted to members 132 and 134 (see arrows 129, 131) to oscillate shafts 140 and 142 in alternating clockwise and counter-clockwise directions (see arrows 135, 137), causing paddles 152 and 154 to beat upon and hence jog the sides S1 and S2 of the signatures S being accumulated upon the tines 84-1 through 84-3 of a bucket assembly 30. The corner members 156 and 158 engage the sides S1-S3 and S2-S3 forming corners of the batch of signatures facilitating the formation of a neat stack by jogging the signatures along the sides S1, S2, S3. Paddles 152 and 154 are preferably formed of a suitable lightweight yet rugged transparent material to facilitate observation of the signature batch being formed.

The elongated slots 144a and 146a provided in members 144, 146 permit adjustment of paddles 152 and 154 to accommodate signatures of different widths over a relatively broad range. Similar slots 156a, 158a in corner members 156, 158 allow adjustment in the perpendicular direction to accommodate different sized signatures. The axes of rotation of the paddles 152, 154 may also be adjusted and are preferably closer to the L-shaped corner members 156 and 158 than the opposite ends of paddles 152, 154.

An alternative embodiment for the paddle assembly is shown in FIGS. 2*i* and 2*j* and comprises a pair of mounting brackets 602, 604, each having openings 602*a*, 602*b* and 604*a*, 604*b* for mounting upon the stacker 10 as shown in FIG. 1*b*. Eyelets 602*c*, 602*d*, 604*c*, 604*d* are provided for receiving an elongated pin 606, 608 having an enlarged head. Each pin is inserted through an associated pair of eyelets 602*c*, 602*d*, 604*c*, 604*d*, and an elongated opening 610*a*, 612*a* in each panel 610, 612, such as opening 612*a* for pivotally mounting the panel assemblies along the wall W of the stacker 10 as shown in FIG. 1*b*. Three pairs of mounting openings 614*a*, 614*b* and 614*c* and 616*a*, 616*b*, 616*c*, are arranged on opposite sides of the path of movement of the buckets, enabling positioning of the panels either closer together or further apart, depending upon the size of the signatures being stacked.

A pair of right angle gear boxes 618, 620 each have a gear 619, 621 driven by the infeed section chains 57 (see FIG. 2) for rotating their output shafts 618*a*, 620*a*. A disc 622, 624 is coupled to each output shaft and is provided with an eccentrically mounted pin 622*a*, 624*a*, each being selectively insertable into one of the openings in arcuate shaped levers 626, 628, depending upon the mounting openings 614*a*–614*c* used to mount the paddle brackets 602, 604, each such lever being pivotally connected by a pivot pin 630, 632, to a bracket 634, 636 mounted along the exterior surfaces of paddles 610 and 612. The upper/outer portions 610*b*, 612*b* of panels 610 and 612 are bent outwardly to guide signatures from the infeed section toward the bucket receiving signatures.

The discs 622, 624 cause reciprocating movement of the panels 610, 612 about the pivot pins 606, 608. The levers 626 and 628 are provided with a plurality of openings to accommodate for the movement of the panel assemblies further apart or closer together through the use of the pairs of openings 614*a*–614*c* through 616*a*–616*c*. The reciprocation of panels 610 and 612 occurs at a rate which is a function of the speed of the infeed section.

When the bucket receiving signatures arrives at the position occupied by bucket 30' shown in FIG. 2*a*, the cam follower rollers 86 and 88 engage the cam surfaces of zero force cam members 164 and 166 secured to the lower ends of support plates 36 and 38. Zero force cam members 164 and 166 have diagonally aligned cam surfaces 164*a*, 166*a*, each of which engage one of the cam follower rollers 86, 88 at an angle to apply a counteracting force to the cam follower rollers 86 and 88 and hence to the bucket assembly 30' which substantially fully compensates for the downward force acting on each bucket due to the weight of the bucket and the weight of the signatures collected thereon. The zero-force cams prevent the application of variable and spurious forces from being applied to the drive chains 32 and 34 at the moment that the bucket 30 in the "home" position is unlatched, thereby assuring that the force applied to the bucket being unlatched is uniform during the occurrence of each unlatching operation, regardless of the weight of the signatures stacked on the previously unlatched bucket. The stacking of signatures of different counts does not alter the accelerating speed of the intercept operation.

As the cam follower rollers 86 and 88 move downwardly and ride off of the zero force cam members 164 and 166, they rollingly engage the curved surfaces 168*a*, 170*a* of a pair of linearly movable plates 168 and 170 secured to the ends of shaft 72.

Rollers 172 and 179 (FIG. 2*b*) are respectively secured to the left-hand and right-hand ends of shaft 72. A roller 174 is secured to the lower end of plate 168 by fastening member 176. Plate 170 is secured directly to the right-hand end of shaft 72. Roller 178 is secured by suitable fastening means near the lower end 170*a* of plate 170. Rollers 172 and 174 move within slot 36*b* while rollers 178 and 179 move within slot 38*b* to prevent shaft 72 from rotating about its longitudinal axis as it moves linearly up and down due to the dynamic forces applied to shaft 72 by drive chains 32 and 34, and springs 78-1 through 78-4.

The arcuate surfaces 168*a* and 170*a* are rollingly engaged by cam follower rollers 86 and 88 respectively, as bucket 30', for example, moves from the position shown in FIG. 2*a* toward the position occupied by bucket 30''. Curved surfaces 168*a* and 170*a* cooperate with chains 32, 34 to cause the inclined signature supporting surface defined by the tines 84-1 through 84-3 of the bucket 30' to move from beneath the completed signature batch, allowing the batch of signatures to drop in a partially free-fall fashion downwardly. The movement of the tines 84 occurs at a velocity which permits the signature batch to follow this movement due to the force of gravity exerted thereon until the point at which the bottom of the signature batch supported by the bucket arrives at a nearly horizontally aligned position, whereupon the bucket moves faster than the batch allowing the signature batch to drop downwardly in a purely free-fall fashion on to the turntable assembly.

The split turntable assembly 200, shown in FIGS. 1*a*, 3*a*, 3*b* and 3*c*, is comprised of a common support plate 210 having a lower sun gear 224 positioned beneath common support plate 210 and rotatably secured thereto by means of a shaft mounted in opening 276 of support member 210 and having its lower end joined to sun gear 224 by suitable bearing means. Three additional elongated shafts 212, 214, and 216 are rotatably mounted within bearings 218, 220, and 222 mounted upon common support plate 210. Shafts 212, 214, 216 extend downwardly through support plate 210. Three planetary gears 226, 228 and 230 are secured to the lower ends of shafts 212, 214 and 216 and mesh with lower sun gear 224, as is shown best in FIG. 3*c*. Air cylinder assembly 232 is pivotally mounted to the underside of common support plate 210 by bracket assembly 234 and has a piston (not shown) slidably mounted within the air cylinder and coupled to a piston rod 232*a* whose free end is swingably mounted to sun gear 224 by pin 236 (FIG. 3*b*), pin 236 being located at a spaced distance from the central axis of shaft 276 upon which lower sun gear 224 is rotatably mounted. Air cylinder 232 is provided with a pair of control openings 232*b* and 232*c* (FIGS. 3*c* and 3*d*) adapted to receive air under pressure to respectively extend and retract piston rod 232*a* to impart rotation to sun gear 224, for rotating sun gear 224 through an angle of 180° for the purpose of rotating the turntable halves 258 and 260 through a like angle, as will be more fully described hereinbelow.

Figure 3A:
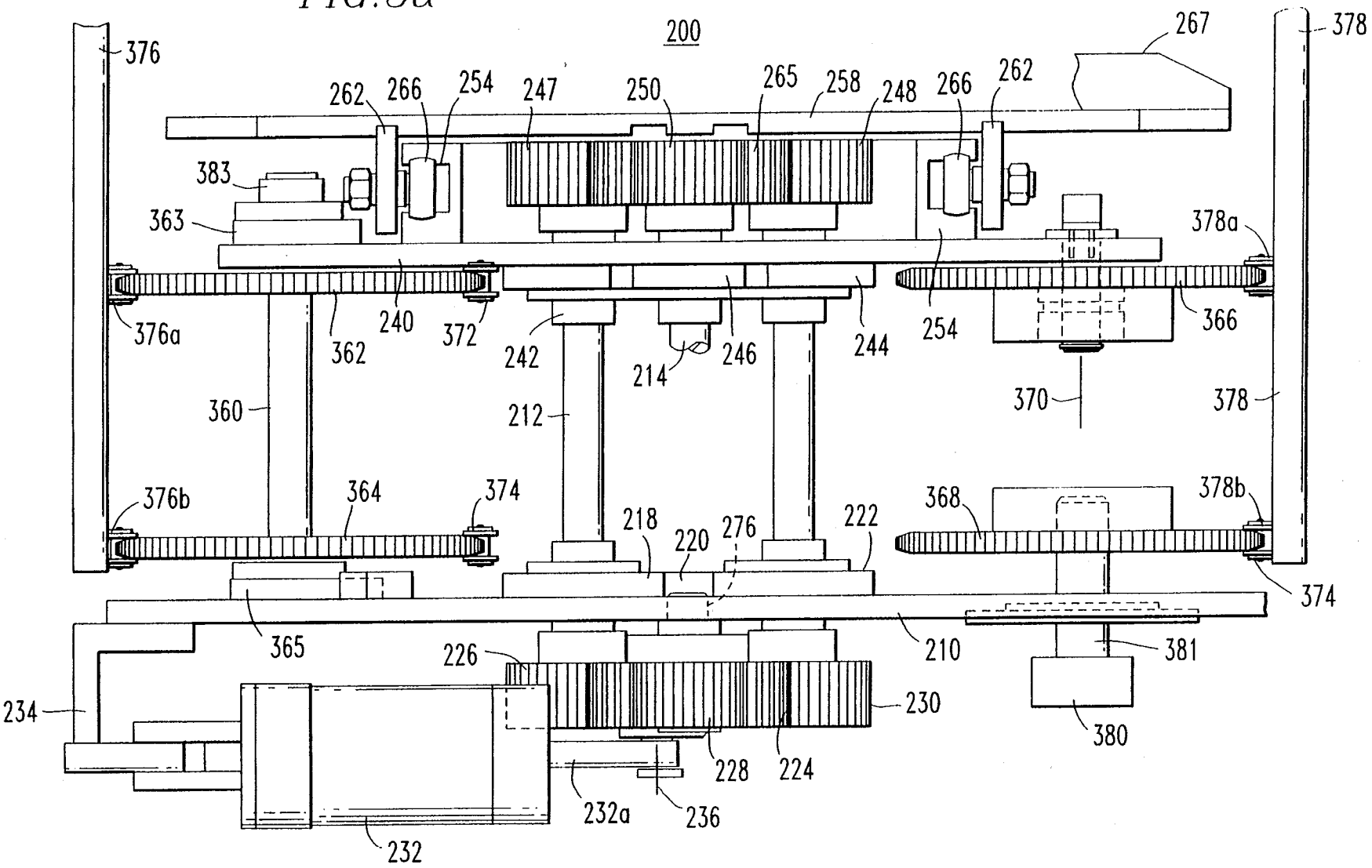

Shafts 212 and 216 extend upwardly through openings in stationary support plate 238, while shaft 214 extends upwardly through support plate 240. Support plates 238 and 240 are secured to support plate 210 by channels 239, 241 welded thereto as shown in FIGS. 3*h* and 3*g*. Bearing assemblies 242 and 244 are secured to the underside of support plate 238 while bearing assembly 246 is secured to the underside of plate 240. Shafts 212 and 216 extend upwardly through plate 238. Planetary gears 247 and 248, respectively, are mounted at the upper ends of these shafts. Shaft 214 extends through support plate 240, and planetary gear 250 is secured to the upper end of this shaft. Planetary gears 247, 248 and 250 are identical in size and number of teeth to planetary gears 226, 228 and 230. The size and tooth spacing of gear segments 263, 265 and sun gear 224 are equal.

Arcuate shaped tracks 254 and 256 (FIGS. 3*a*, 3*b*, 3*g*, 3*h*, 3*i*) are mounted upon each of the stationary support plates 238 and 240 respectively. Each track has a substantially C-shaped cross-sectional configuration as shown best in FIG. 3*a*. The ends of the arcuate-shaped tracks are spaced apart from one another to form a clearance gap G1 (see FIG. 3*g*) to permit a pusher rod 376 or 378 to move therebetween for the purpose of pushing a completed signature stack from the turntable assembly 200, as will be more fully described.

Figure 3B:
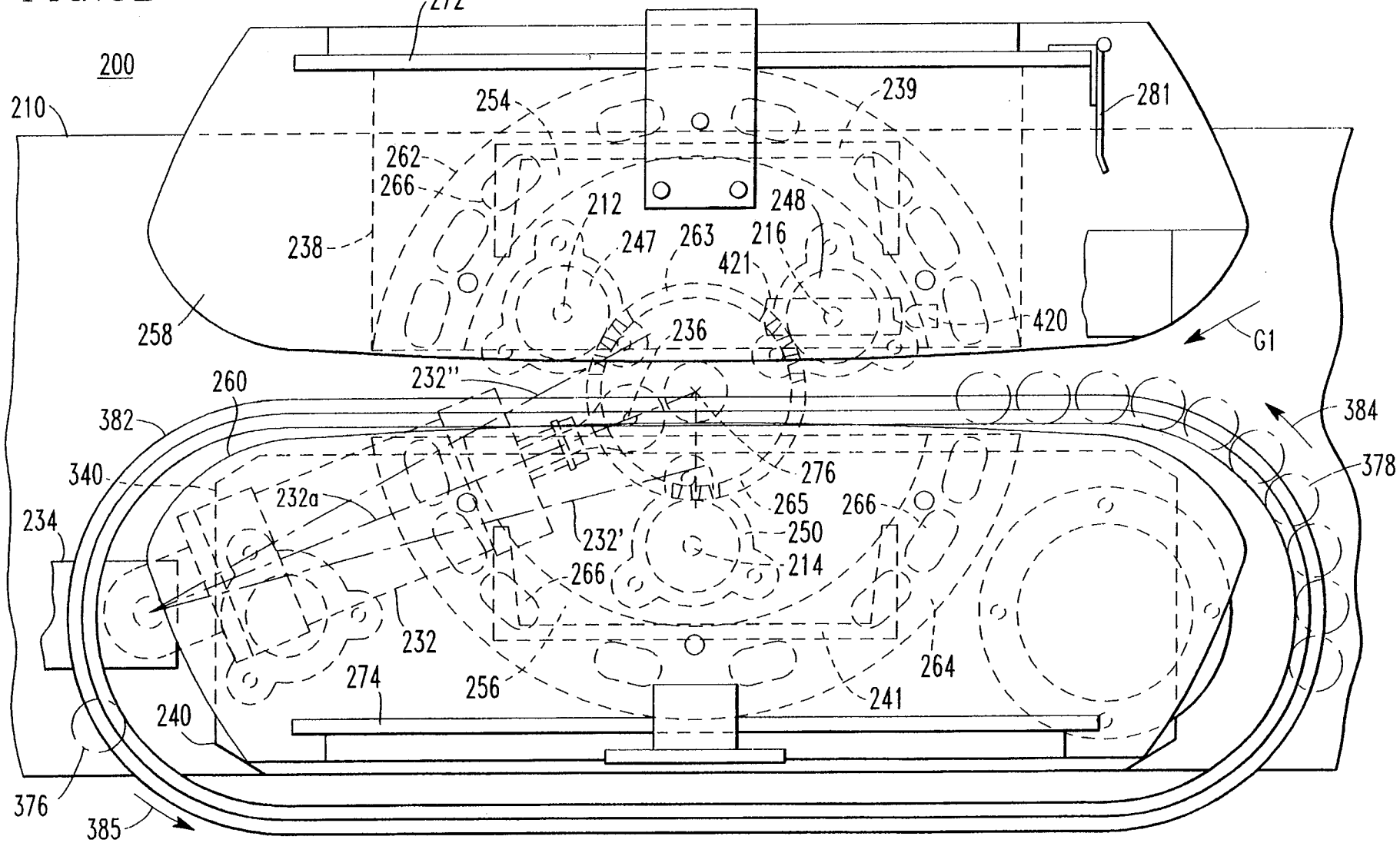
Figure 3E:
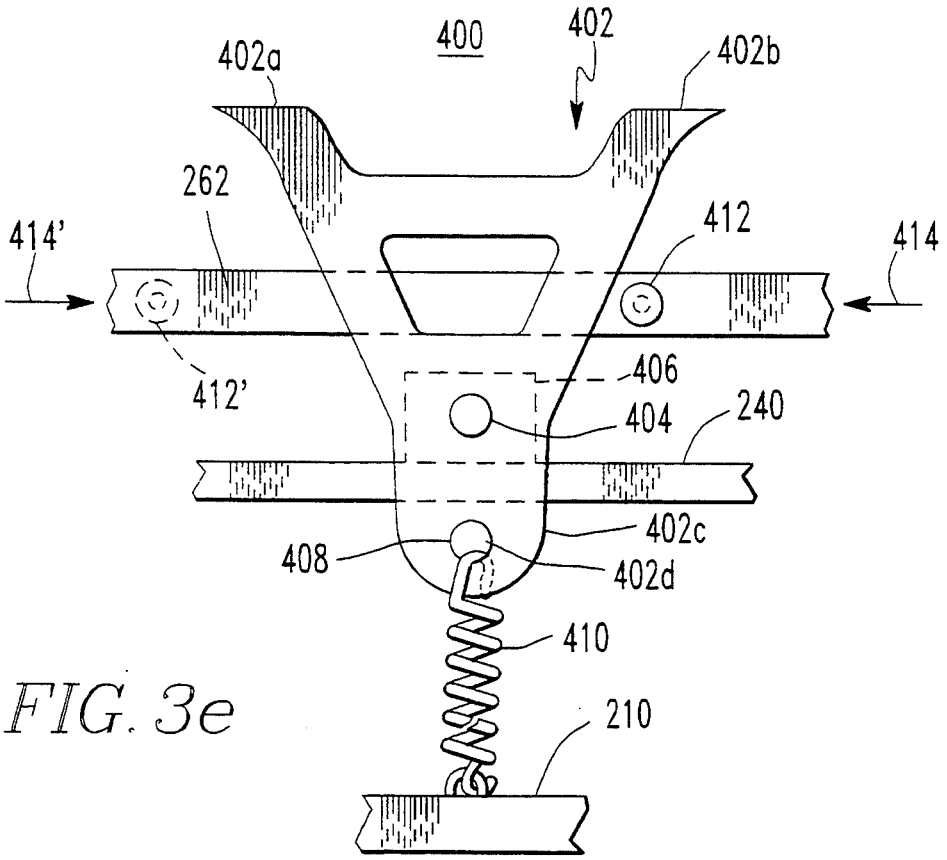
Figure 3F:
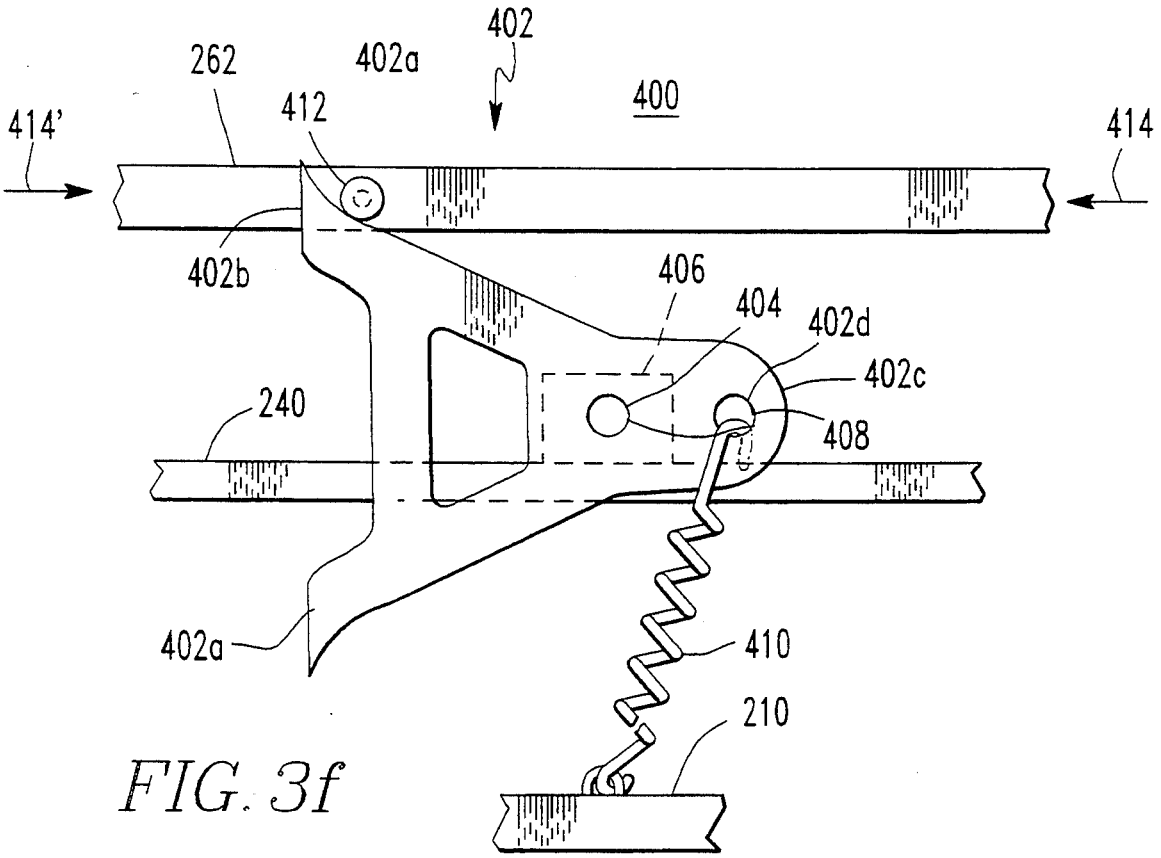
Figure 3G:
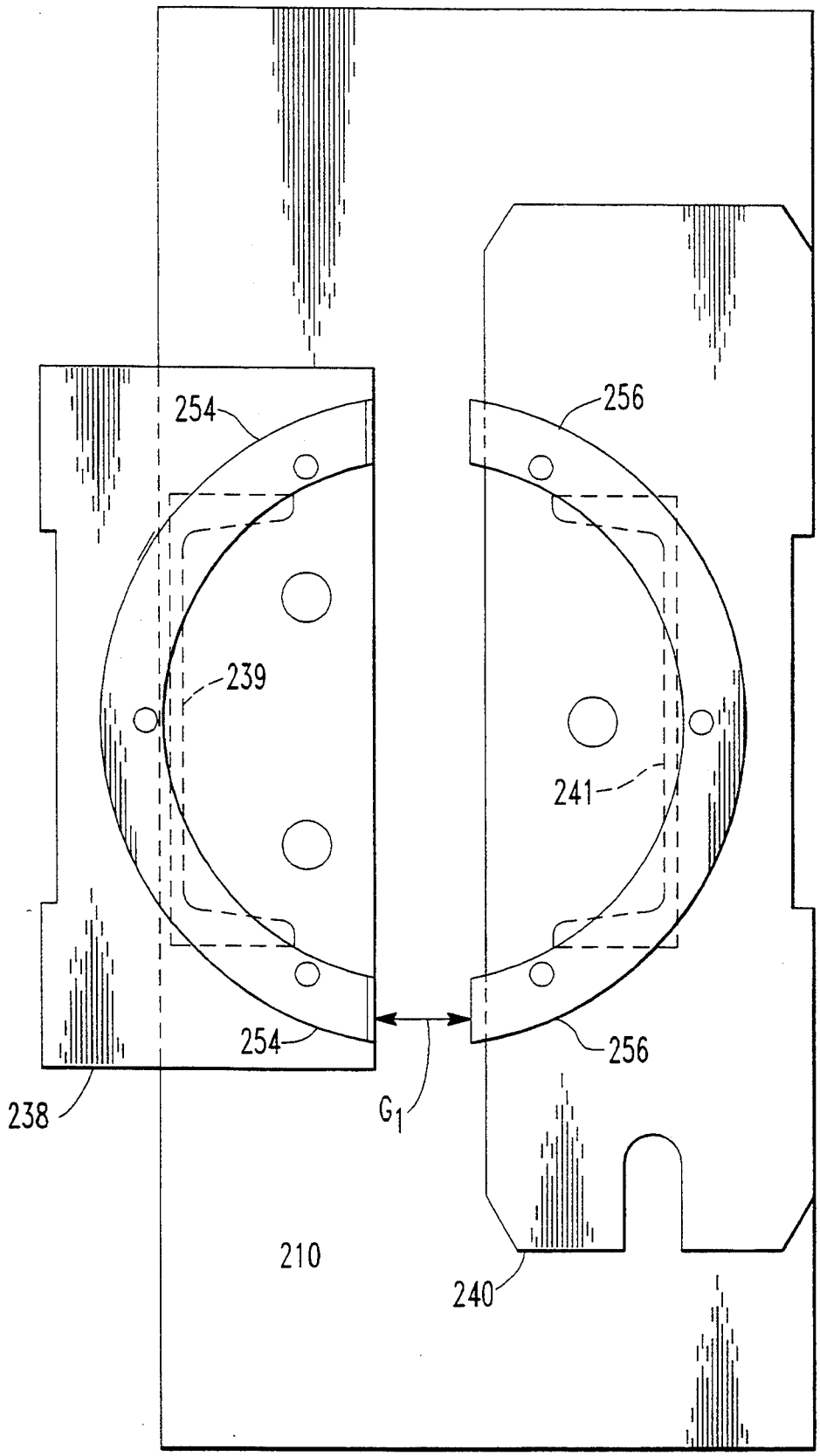
Figure 3H:
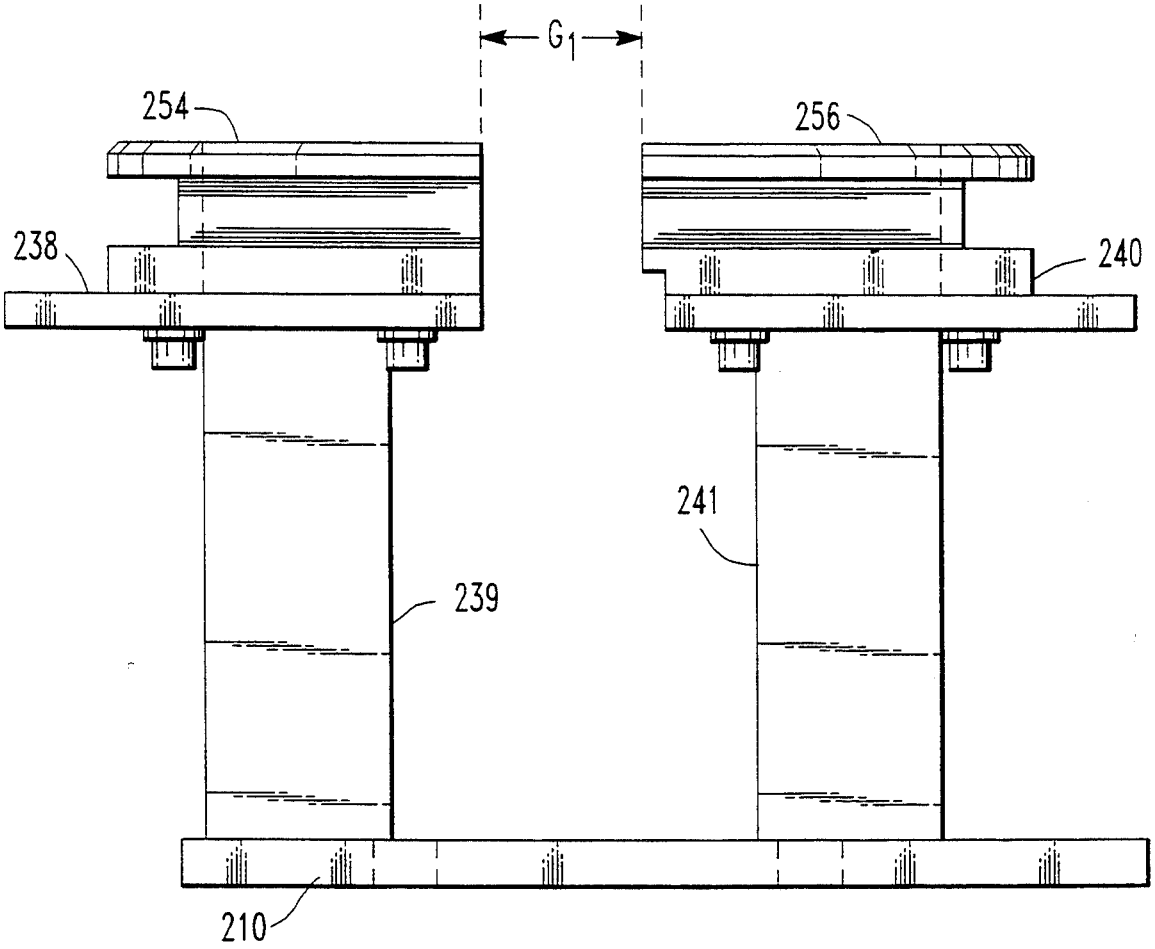
Figure 3I:
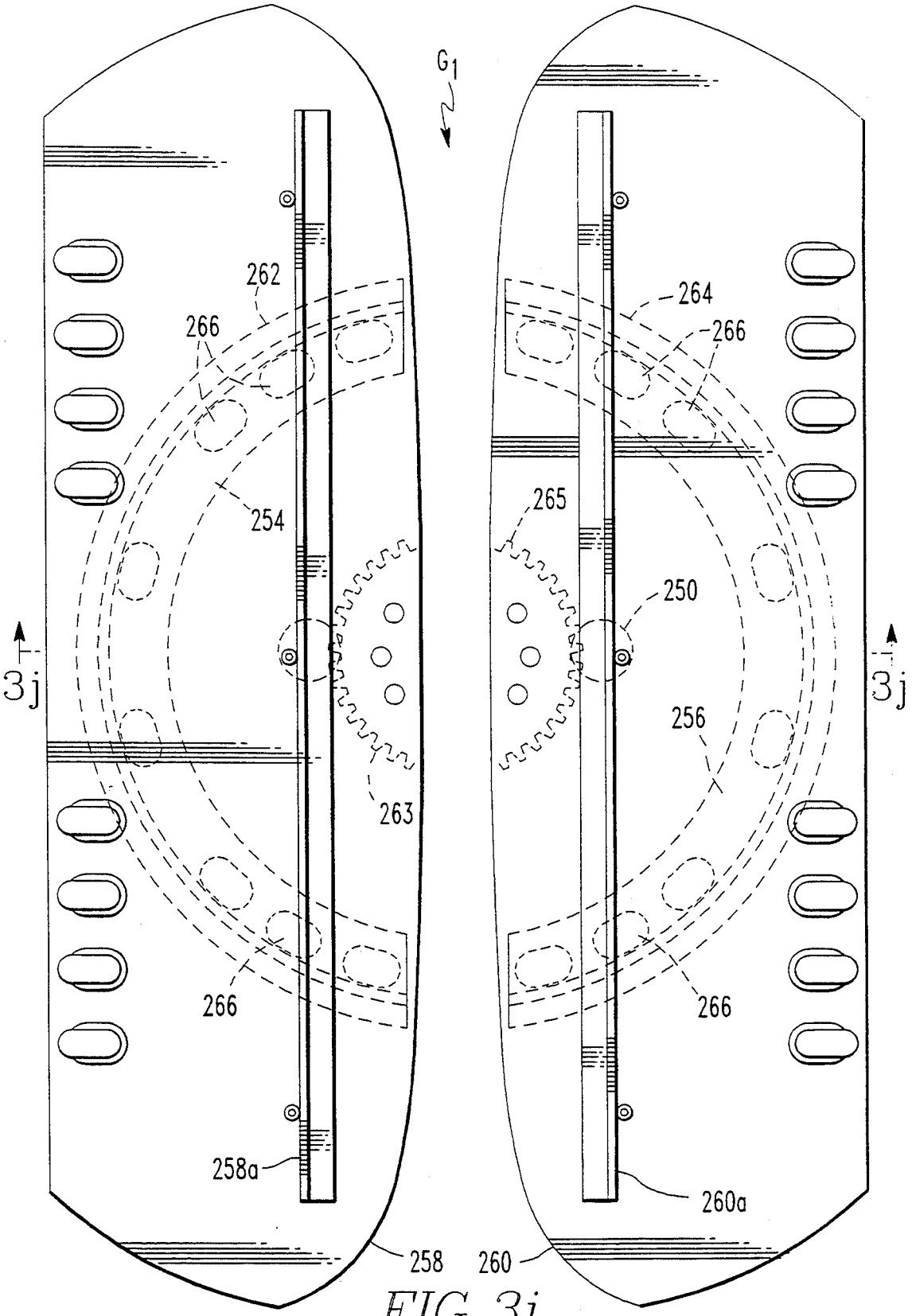
Figure 3J:
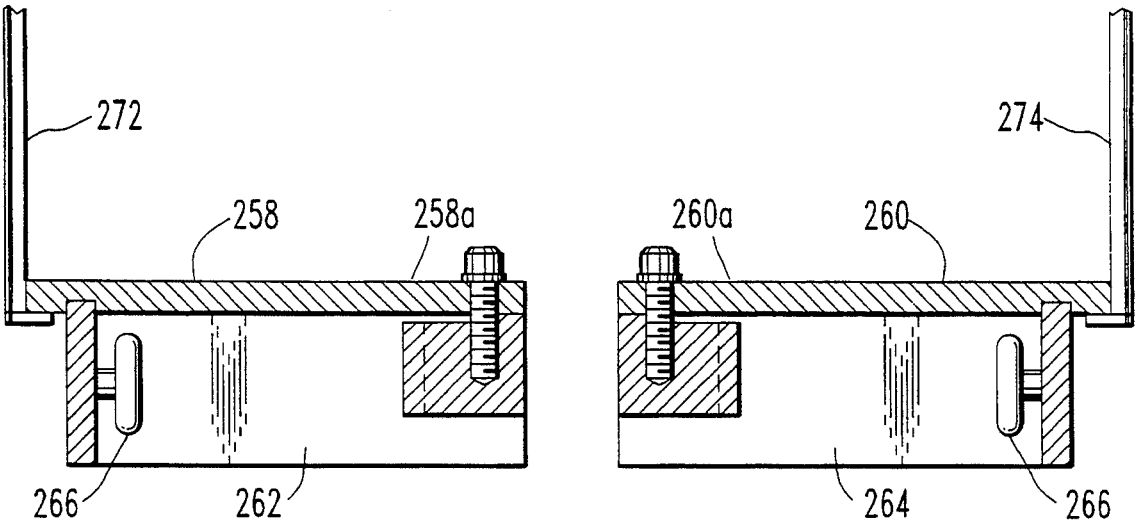

The stacker turntable assembly 200 is further comprised of a split turntable collectively defined by turntable halves 258, 260 (FIG. 3*j*). Arcuate-shaped roller support members 262, 264 are respectively secured to the underside of each of the turntable halves 258, 260 and each support 262, 264 supports a plurality of roller assemblies 266 arranged at spaced intervals about each of the support members 262 and 264, so that the rollers 266 of the roller assemblies ride within the C-shaped portions of tracks 254 and 256.

Gear sections 263 and 265 are secured to the underside of turntable halves 258 and 260 and selectively mesh with planetary gears 247, 248 and 250, each sun gear section 263 and 265 always meshing with at least one and in some cases two of the three sun gears 247, 248 and 250 at any given time.

Air cylinder 232 moves back and forth between the over-center dotted line positions 232' and 232" shown in FIG. 3*b* to rotate lower sun gear 224 through 180°. The gear ratios between gear 224 and lower planetary gears 226, 228 and 230 is such as to cause each of these planetary gears to rotate through one full revolution (i.e., 360°) for each half-revolution experienced by sun gear 224. Gears 247, 248 and 250 thus rotate through one full revolution and have the same gear ratio with the upper sun gear comprised of gear sections 263 and 265, causing the gear sections 263 and 265 and hence the turntable halves 258 and 260 to be moved about the curved tracks 254 and 256 in such a way that the turntable halves 258, 260 effectively rotate about an imaginary vertical axis 276, through an angle of 180° for each half-revolution experienced by sun gear 224.

The air cylinder 232 may be substituted by a motor drive which rotates the turntable in the same direction during each rotation. FIG. 3*c*-1 shows an alternative arrangement in which the turntable halves 263, 265 are rotated by a belt 700 which may drive turntable halves by a friction drive or may comprise a chain engaging the teeth of turntable halves 263, 265 shown in FIGS. 3*a*, 3*b*. Belt 700 encircles circular discs 702, 705 which are mounted on shafts 704, 706 and may either be a gear engaged by a chain or pulleys engaged by a belt. The shaft 704 may be rotated by an air cylinder 708 coupled to link 710. The air cylinder 708 and line 710 may be replaced by a drive motor or by the principal drive of the stacker coupled to shaft 704 through a clutch assembly (not shown).

The rollers 266 arranged on each arcuate support member 262 and 264 sequentially move out of the tracks 254 and 256, across the center gap G1 and into the tracks 256 and 254, respectively, until they have completely reversed positions, at which time the platform has rotated through an angle of 180°.

The turntable halves 258, 260 undergo rotation through an angle of 180° after each signature batch is delivered thereto (except for the last batch of the stack) in order to form a compensated stack. The direction of rotation of platform halves 258, 260 is reversed in an alternating fashion, in the preferred embodiment.

Each of the turntable halves 258 and 260 (FIG. 3*j*) is provided with an elongated substantially V-shaped groove 258*a*, 260*a* for receiving and supporting the clamping portion 271, 275 of an elongated brush assembly 273 and 277, respectively (FIG. 3*k*), each secured to turntable halves 258 and 260 by a hold-down elongated brush bar 267 and 269, respectively.

Upright side walls 272 and 274 (FIG. 3*j*) are joined at their lower ends to turntable halves 258 and 260. The ends of sidewalls 272, 274 are provided with spring-loaded corner assemblies 281 (only one being shown in FIG. 3*b* for purposes of simplicity) to embrace the corners of a signature stack as the turntable rotates and thereby prevent sidewise movement of the stack or of individual signatures.

FIGS. 3*e* and 3*f* show an anti-backlash assembly 400 comprised of a Y-shaped member 402 swingable about pivot pin 404 supported by a pivot block 406 secured to stationary plate 240.

A helical spring 410 has its lower end secured to stationary plate 210 and its upper end secured to a pin (or opening) 408 mounted near the lower end of member 402. The upper arms 402*a* and 402*b* of member 402 extend upwardly and outwardly and are selectively engageable either by a roller 412 or a roller 412' rotatably mounted to platform half 260.

It should be understood that a pair of anti-backlash assemblies are provided and are each pivotally mounted to one of the plates 238, 240. Since each functions in substantially the identical manner, only one has been described herein for purposes of simplicity.

The operation of the anti-backlash assembly 400 is as follows:

As turntable half 260 moves to complete rotation through one-half revolution, roller 412, moving in the direction shown by arrow 414, engages the edge of arm 402*b*. As turntable half 260 moves from the position shown in FIG. 3*e* to the position shown in FIG. 3*f*, roller 412 drives member 402 to swing counterclockwise from the position shown in FIG. 3*e* to the position shown in FIG. 3*f* causing the spring 410 to become charged. The anti-backlash assembly 400 arranged upon the platform half 240 operates in the identical fashion, both assemblies cooperating to perform the same action.

When the turntable halves are rotated in the reverse direction, platform half 260 and hence pin 412', moves in the direction shown by arrow 414' toward the anti-backlash assembly 400. The spring charging operation is substantially identical as that described above, except that member 402 is caused to rotate clockwise by roller 412'. The selective engagement of pins 412 and 412' with member 402 acts to minimize backlash in the turntable drive train shown in FIG. 3*c*. The member 402 reaches the position shown in FIG. 3*f* when the turntable has completed rotation through a half-revolution. Also, during the start of rotation, the charged spring 410 of each anti-backlash assembly 400 provides some starting energy upon initiation of rotation of the turntable halves 258, 260, as well as absorbing some of the stopping force. Thus, the anti-backlash mechanism takes all of the backlash out of the drive train at its receiving and discharge positions and secondarily absorbs and returns rotational energy to the turntable.

Figure 31:
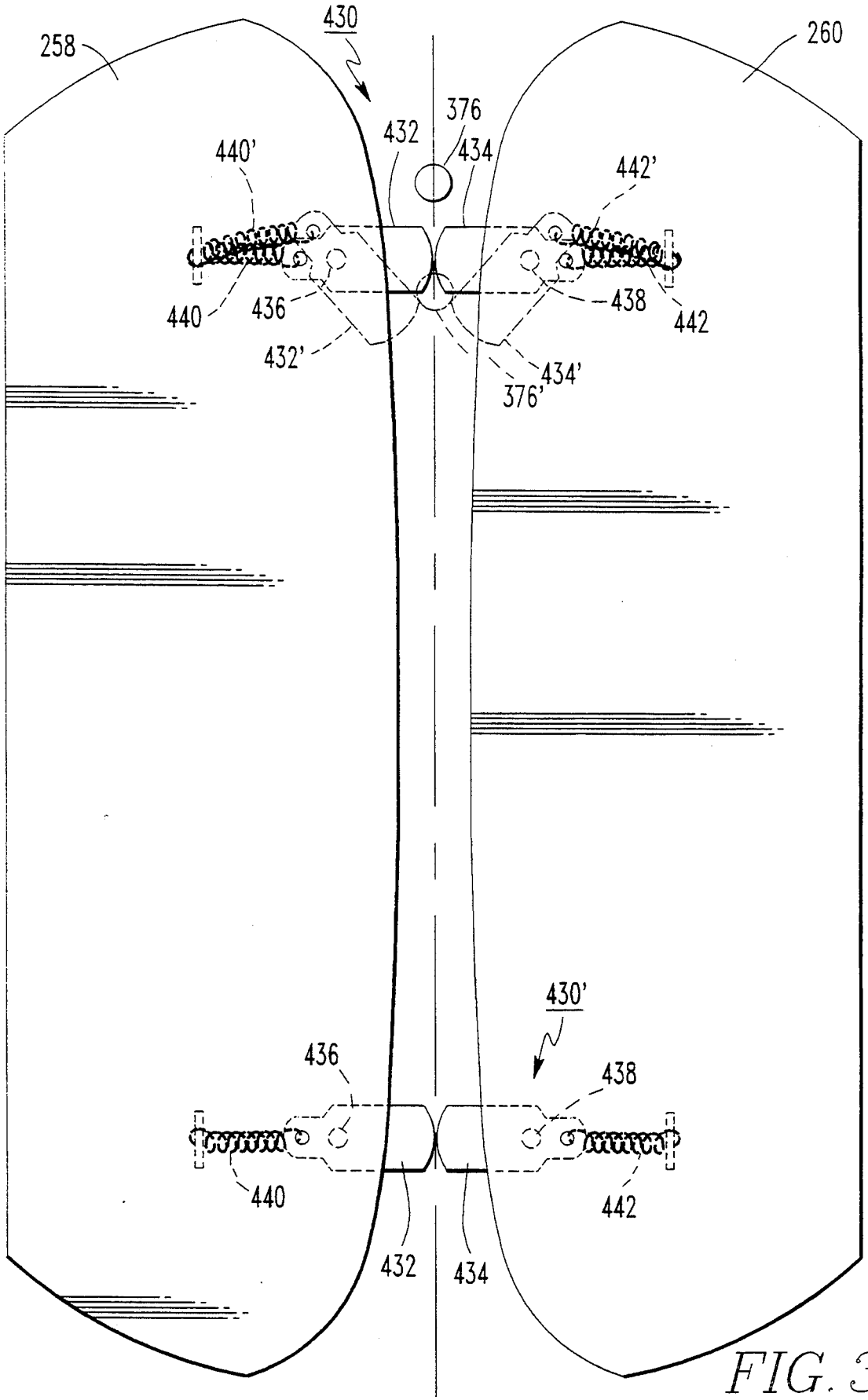

The turntable halves 258 and 260 are further provided with spring-loaded gate assemblies 430 and 430' which are normally arranged in the manner shown in FIG. 31 and which are swingable to allow the passage of a pushrod 376 or 378. Each gate assembly 430, 430' is comprised of first and second rotatably mounted gate members 432, 434 secured to the underside of platform halves 258 and 260 by pins 436, 438. Springs 440 and 442 normally urge the gate members 432 and 434 to assume a closed position with their longitudinal axes in alignment with an imaginary line between their pivots 436 and 438. As a pushrod 376 moves into the elongated gap G1 between platform halves 258 and 260 and engages gates 432 and 434, the gates are moved respectively clockwise and counterclockwise to the positions shown at 432' and 434' to allow for the passage of pushrod 376. After the pushrod passes between gates 432 and 434, centering springs 440 and 442 return gate members 432 and 434 to their closed and enraged position.

The pushrod 376 continues to move along the central gap G1 and eventually engages gates 432 and 434 of assembly 430', causing them to rotate clockwise and counterclockwise respectively to allow for the passage of the pushrod 376 out of gap G1. The gates operate in the same manner when a pushrod moves in the opposite direction through gap G1.

During rotation of turntable halves 258 and 260, gates 432 and 434 of each of the assemblies 430 and 430' remain closed and in engagement, assuring that the turntable halves move in unison. For example, in the event that turntable half 258 rotates at a rate slightly greater than platform half 260 or in the event that the load imposed upon the upper sun gears 246, 248 and 250 by the platform halves 258, 260 is non-uniform, the gate assemblies immediately correct these conditions by assuring that platform halves 258 and 260 are maintained in the spaced relationship determined by gate assemblies 430 and 430' as they rotate in forming a compensated stack of signatures.

A completed compensated stack is removed from the turntable halves 258, 260 (FIG. 3*a*) by a pusher assembly comprised of pushrods 376 and 378, having joining means 376*a*, 376*b*, 378*a*, 378*b*, for respectively coupling the push rods to upper and lower pushrod chains 372 and 374.

Sprockets 362 and 364 (FIG. 3*a*) are mounted upon common shaft 360 and are journaled within bearings 363 and 365. Shaft 381 is coupled to the output shaft of motor 380, which rotates shaft 360 through sprockets 368 and 364 and chain 374.

Driven sprockets 364, 366 and 362 are each freewheelingly journaled within suitable bearings provided in support plates 240 and 210. Chain 372 is entrained about sprockets 362 and 366, while chain 374 is entrained about sprockets 364 and 368. The chains 372, 374 have been removed from FIG. 3*a* except for a few links to facilitate a better understanding of the components behind the chains. The chains alternatively may be other flexible means such as belts.

The path 382 followed by the chains 372 and 374, and hence by the pushrods 376 and 378, is shown in FIG. 3*b*. As one example, while pushrod 378 is moving in the direction shown by arrow 384 to pass through gap G1, push rod 376 moves in the direction shown by arrow 385 to pass about the exterior periphery of turntable half 260. Motor 380 is bi-directional enabling pushrods 376, 378 to be moved in the reverse direction, as well as the direction shown by arrows 384 and 385 in FIG. 3*b*.

The pushrods each move through the center of rotation of the turntable and move along the same path and at the same velocity as the carrier chains around the entire path of movement including the push portion and the return portion of movement.

Figure 3K:
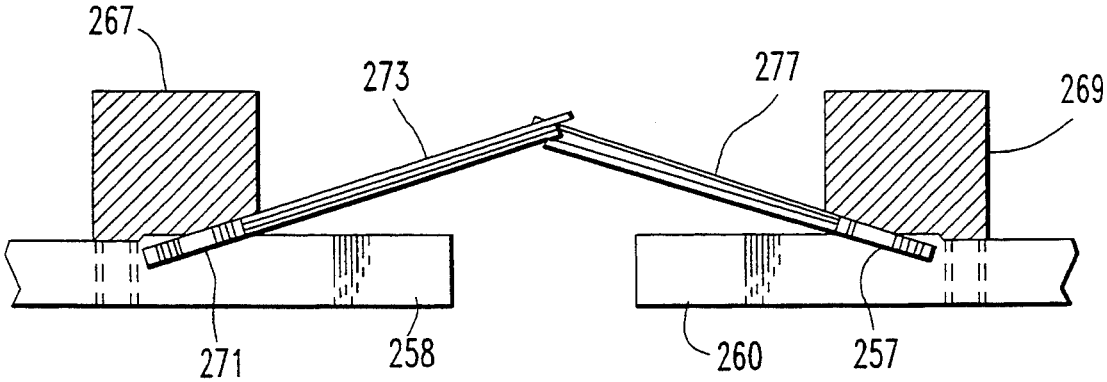

The turntable hales 258 and 260, as shown in greater detail in FIGS. 3*i*, 3*j* and 3*k*, are each provided with an elongated substantially V-shaped groove 258*a*, 260*a* for receiving and aligning an associated elongated holder portion 271, 275 of an elongated brush assembly having bristles 273, 277. Elongated holder members 267 and 269 clamp the brush holders 271 and 275 in position.

The free ends of the brush assemblies overlap in the manner shown in FIG. 3*k*, and form resilient means to close gap G1 preventing signatures and/or debris from entering the gap which closure is yieldable to permit a pushrod 376 or 378 to freely pass therethrough during the time that a signature stack is being removed from the turntable assembly.

The operation of the stacker 10 of the present invention is as follows:

The machine control panel C includes a START/-CLEAR pushbutton, a STOP pushbutton, a LEFT pushbutton, a RIGHT pushbutton, an ALTERNATE pushbutton, and a BYPASS selector switch. Pressing the START/CLEAR pushbutton for a brief duration applies electrical power to all drive devices, pressurizes the pneumatic system and causes a clearing cycle. Pressing the START/CLEAR pushbutton for an extended duration causes the stacker to execute a clearing cycle including opening of the BYPASS gate through actuation of the air cylinder 19. Once cleared, if the START/CLEAR pushbutton is again pressed, the BYPASS gate will open, one machine cycle will be executed, and the BYPASS gate will close at which time the stacker is again prepared to receive signatures.

Pressing the STOP pushbutton causes an immediate shutdown of the stacker by removing power from all drive devices and depressurizing the pneumatic system.

Pressing the LEFT pushbutton causes the next and all succeeding stacks to be discharged from the left side of stacker 10. Pressing the RIGHT pushbutton causes the next and all succeeding stacks to be discharged from the right side of the stacker. Pressing the ALTERNATE pushbutton will cause all succeeding stacks to be discharged from the left and right sides of stacker 10 in an alternating fashion. The LEFT, RIGHT and ALTERNATE pushbuttons are designed to be illuminated when pressed and to remain so until another selection is made.

The BYPASS selector switch, when moved to its alternate position will cause the BYPASS gate to open. Placing the switch in its normal position will cause the BYPASS gate to close.

The lower input conveyor portion 18 (see FIGS. 1*a* and 2) is swingable between the operative (solid line) position and the open (dotted line) position 18' under control of air cylinder 19, moving both the air cylinder 19 and the lower conveyor section 18 to move the lower conveyor section 18 to dotted line position 18' to alleviate a jam condition by preventing build-up of signatures within the input section of stacker 10. Triangular-shaped baffle assembly 21 prevents signatures released from the input section from entering into the stacker 10 and deflects the signatures downwardly and away from stacker 10 where they may fall harmlessly to the floor.

The power train for the input conveyor is shown in FIG. 2. A motor 54 coupled to speed reduction unit 56 drives a chain 57 which, in turn, drives sprockets 59, 61, 63 and 65. Sprockets 59 and 61 drive upper and lower conveyor sections 16 and 18. Sprocket 63 maintains drive chain 57 under proper tension. Chain 57 rotates gear 25 which is sensed by sensor 23 to generate pulses representing the movement of signatures through the input section. The chain 57 also drives the shaft 122 (shown in FIG. 2) of the paddle assembly 120 (FIG. 2*g*).

A signature stream enters between conveyor assemblies 16 and 18. Signatures are sensed by sensor 20 to develop a signature count employed by controller 24. As each signature leaves the conveyor assemblies 16 and 18, jogger paddles 152 and 154 guide and align the signatures moving toward the stacking region.

Signatures are stacked on each bucket 30 as the bucket moves downwardly under the control of chains 32, 34. As the first paper in a batch of signatures is counted, the bucket latched in the home position is unlatched after a delay by piston assembly 102 under control of controller 24 (see FIGS. 2*a* and 2*d*). The movement of the chain 32 (or chains 32, 34) away from its (their) normal path due to cocking cam(s) 94 moves shaft 72 upward, which charges springs 78-1 through 78-4. Upon movement of the latch arm 98, the charged energy in the aforementioned springs 78-1 through 78-4 causes the bucket 30 unlatched from the home position to abruptly move into the signature stream.

Just prior to the moment that the bucket is unlatched, the tines of the bucket in the home position are located just above the lower edge 22*a* of guide bar 22, shown in dotted fashion in FIG. 2*a*. Upon unlatching, the cam follower roller 86 of the unlatched bucket moves and strikes the inclined surface 401*a* (see FIG. 2*e*) of a horizontally adjustable travel limiting plate 401. Plate 401 is secured to each side plate 36, 38 by means of fasteners (not shown) passing through elongated openings 401*b*. Adjustable plate 401 is movable in either direction as shown by double headed arrows 403, to control the location of the bucket after it is released from the home position, and to control the position occupied by the free ends of the tines 84. The distance of travel from the home position to the position where the cam follower 86 strikes inclined surface 401*a* is made adjustable to accommodate the interception of a signature stream having signatures of greatly varying thickness.

The unlatched bucket 30 moves into the signature stream preventing further signatures from being collected by bucket 30' and diverts subsequent signatures in the incoming stream to be stacked upon bucket 30.

After a program controlled delay sufficient to allow the last signature delivered to the previously unlatched bucket to reach the top of the batch of the decelerating bucket, the electromagnetic clutch 64 and electromagnetic brake 66 are operated to move bucket 30 downwardly through the stacking region.

As the unlatched bucket moves through the stacking region and receives signatures, the paddles 152 and 154 beat against the signatures being stacked and thereby cooperate in the formation of a neat signature stack upon the bucket (see FIG. 2*g*). Paddles 152 and 154 beat against the sides of the signatures while corner members 156 and 158 beat against the cut edges of the signatures to cause the signatures to form a neat batch.

As was mentioned hereinabove, the sensor member 116 senses rotation of timing gear 114 developing pulses which start accumulating as the bucket is unlatched and starts moving down from the home position (see FIG. 2*a*). The pulse count is a measure of the distance traveled downwardly by the bucket from the "home" position. When a bucket has travelled through one-half of the total travel distance between the home and drop-out positions, the signature count is examined to determine how many signatures have been counted. In the event that less than an amount representative of one-half of the signatures forming the signature batch have been counted, the electromagnetic brake 66 and the electromagnetic clutch 64 are operated to halt the movement of the bucket until the desired number of signatures are counted. A similar operation occurs at a subsequent staging location at which time the number of pulses accumulated indicate movement of the bucket through three-quarters of its total travel distance. Again, the bucket is halted for a program adjusted period of time sufficient to allow an amount representative of three-quarters of the signatures to be counted. The buckets may not pause at all under some conditions.

As was pointed out hereinabove, the staging locations may be greater or lesser in number and may be at other positions along the path of movement of the bucket through the stacking region.

There is always a program-controlled delay to escort the first paper from the position of sensor finger 20*a* of sensor 20 to the free tips of the tines 84-1 through 84-3 of bucket 30. The next bucket moved to the home position is then unlatched from the home position. The bucket accumulating signatures is aligned with its cam follower rollers engaging the zero force cams 164 and 166 at the time that the next bucket is in the home position to compensate for any forces imparted to chains 32 and 34 by the signatures on the loaded bucket, thereby assuring the accelerating force imparted to the unlatched bucket is consistent during each intercept operation.

As the bucket with the completed signature stack moves off of the zero force cams 164, 166, the cam followers move along the cam surfaces of lower cams 168 and 170. After the bottom of the stack is aligned with the horizontal, the tines 84 rapidly move from beneath the completed signature batch and allow the signature batch to drop upon the turntable halves 258, 260 and between the side walls 272 and 274. Once the batch has been deposited upon platform halves 258 and 260 and has come to rest, air cylinder 232 is operated to rotate the platform halves 258, 260 through one-half revolution in readiness for receipt of the next signature batch. The air cylinder 232 moves, for example, from position 232' through the centerline C (FIG. 3*b*) to position 232''. The anti-backlash assemblies 400 absorb the driving energy at the end of travel.

Each subsequent signature batch is deposited upon the turntable, after the completion of rotation of the turntable through 180° to form a compensated stack by arranging the folded edges of adjacent batches along opposite sides of the stack. The turntable does not rotate after completion and removal of the completed stack from the turntable.

When the appropriate number of signature batches have been delivered to the platform assembly, the pushrod assembly motor 380 is operated to move one of the two pushrods through the gap G1. A sensor 420 adjacent to planetary gear 230 (FIGS. 3*b* and 3*c*) senses rotation of metallic member 421 through one full revolution by sensing member 421 twice (i.e. each end of member 421 once) to assure that turntable has rotated through 180° and that the gap between platform halves 258 and 260 is aligned with gap G1. The first time member 421 is sensed, the air flow to air cylinder 232 is reversed.

Controller 24 initiates rotation of the turntable at a program adjusted time delay after a completed signature batch is dropped from a bucket, said adjustable time delay being a function of the vertical drop distance traveled by each signature batch between the drop position and the location where the batch lands upon the turntable, it being understood that each subsequent signature batch delivered to the turntable has a successively shorter travel distance which is reduced by the height of each of the signature batches previously delivered to the turntable. The controller 24 further provides a variable delay between delivery of the last signature batch to the platform assembly, and initiation of movement of the push rod assembly, as a function of the distance traveled by the last signature batch delivered to the turntable.

The controller 24 operates electromagnetic gate valve 21, latch valve 107 and rotate valve 233 (FIG. 3*d*) to operate their associated air cylinders by allowing air under pressure to pass through the associated energized electromagnetic valve from a source coupled to input 450.

The detector 436 is the top of batch sensor (see FIG. 1*a*) and is triggered when a signature or signatures become jammed between a bucket and the guide surface 22*a* to halt operation of the stacker 10. This condition is monitored by controller 24 to open the lower conveyor section 18 (see FIG. 1*a*).

The control panel C (FIG. 1*a*) is conveniently located to facilitate operation of stacker 10 and includes push buttons described hereinabove for turning stacker 10 on and off, starting and stopping stacking, etc.

Figure 4A:
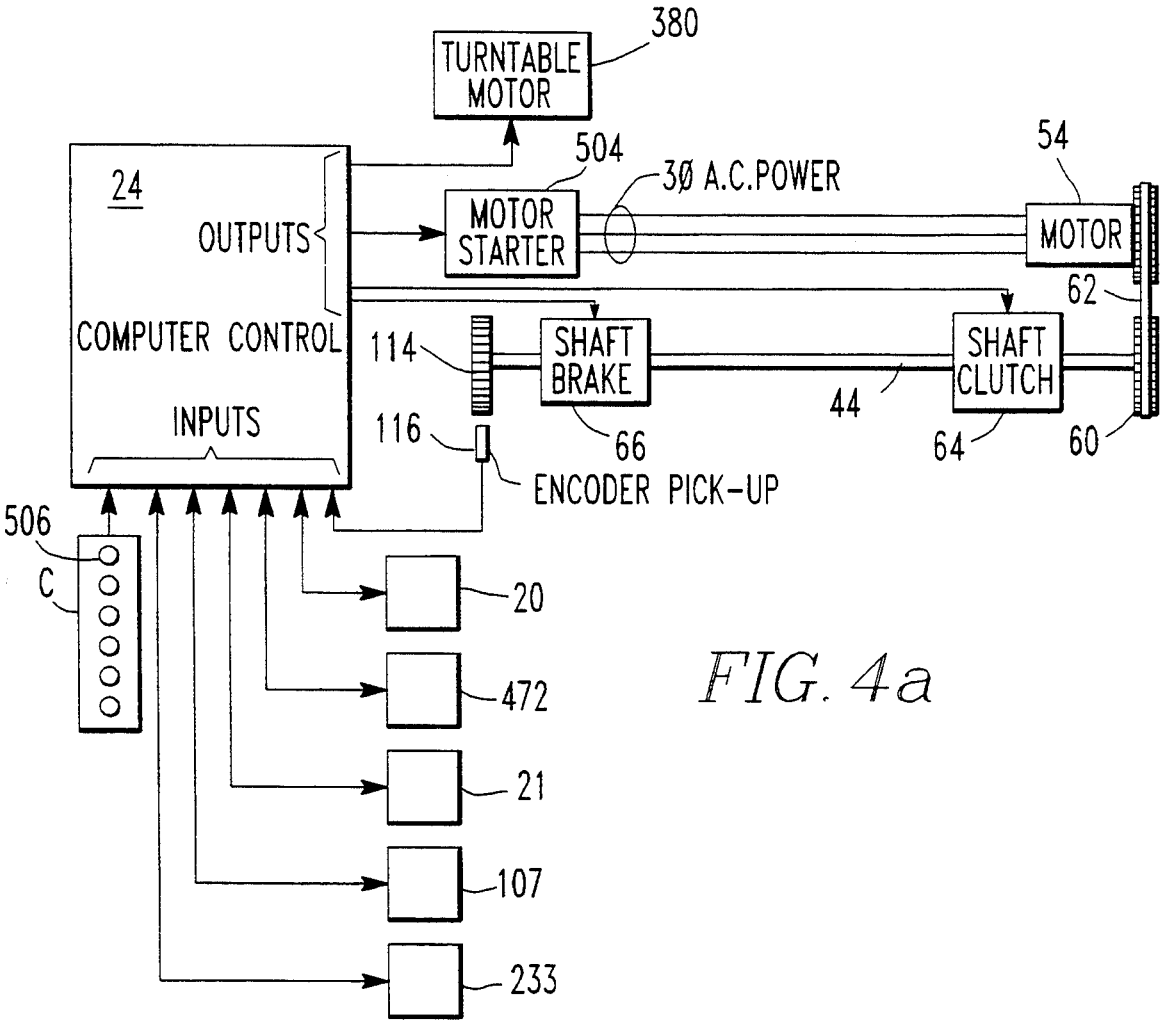

The controller 24 shown in FIG. 4*a* is preferably a microprocessor which monitors control panel C, sensor 20 (see FIG. 1*a*), encoder pick-up 116 (see also FIG. 2*b*), and turntable sensor 472 to selectively control motor starter 504 for motor 54 (see FIG. 1*a*), shaft clutch 64 and shaft brake 66 (both shown in FIG. 2*b*). Controller 24 also controls motor 380 for operating the pusher rods such as 376 (see FIG. 3*a*), latch cylinder valve 107, gate cylinder valve 21 and turntable rotate cylinder valve 233 (all shown in FIG. 3*d*). When stacker 10 is turned on, controller 24 is initialized (FIG. 4*c*). Controller 24 latches cylinder 106 and energizes motor 54 to move one of the stacker assemblies 30 to the home position. Sensor 436 provided at this location indicates that a bucket is in the latched position. The computer also opens and closes dump gate 18 by operating valve 21, rotates the turntable by operating valve 233, and moves one pushrod through the gap G in the turntable by energizing motor 380. These operations assure that the stacker is ready to receive and stack signatures. The initializing routine is shown in FIG. 4*c*.

The sensing of signatures passing beneath signature counter 20 causes controller 24 to unlatch the latched bucket by operation of valve control 107 at the proper time, in order to begin collecting signatures. Controller 24 counts the signatures passing beneath signature sensor 20. When the count of the number of signatures to form the present batch is reached, controller 24, after a delay, unlatches the next bucket presently in the home position, causing the bucket in the home position to move into the signature stream and thereby begin collecting signatures for forming the next batch.

Staging, or incremental movement of the buckets, improves proper collection and alignment of signatures on the bucket.

The movement of the bucket is controlled in accordance with the signature size, signature count and the speed of movement of the signature stream, distance between sensor finger 20*a* and the free ends of tines 84, response speeds of clutch 64 and brake 66 and the distance the bucket must move. The start of movement of a bucket is responsive to papers approaching the bucket which determine:

(a) intercept;
(b) drop delay;
(c) stage one-half; and
(d) stage three-quarters.

The approach velocity and distances are coordinated with the responsiveness of the mechanisms employed in stacker 10 and the velocities and distances they must move to reach the next position. For example, (a) for intercept—latch valve 107, latch 106 the intercept stroke of a bucket from the home position.

(b) for stage one-half—clutch 64, brake 66, bucket acceleration and velocity and distance to stage one-half.

(c) for stage three-quarters—clutch 64, brake 66, bucket acceleration and velocity and distance to stage three-quarters.

(d) for drop delay—clutch 64, brake 66, bucket acceleration and velocity and distance to home position.

Controller 24 carries out the staging technique by examining the count of signatures at predetermined locations along the bucket travel path, and controlling the movement of the bucket in accordance with the number of signatures already collected by the bucket. The computer may be any suitable microprocessor, such as an Intel 8080, including random access and read only memories and an interface for coupling to the various controls and sensors of stacker 10.

In one preferred embodiment, these staging positions are referred to as the half batch position, three-fourths batch position, and home position.

Figure 4B:
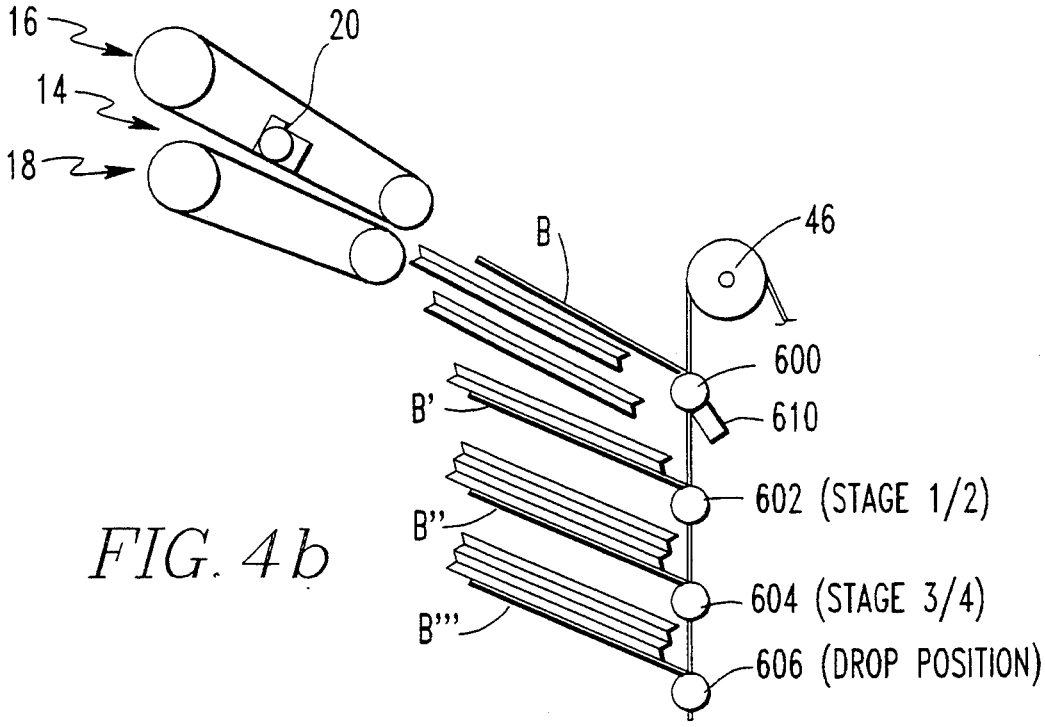
Figures 4C, 4D:
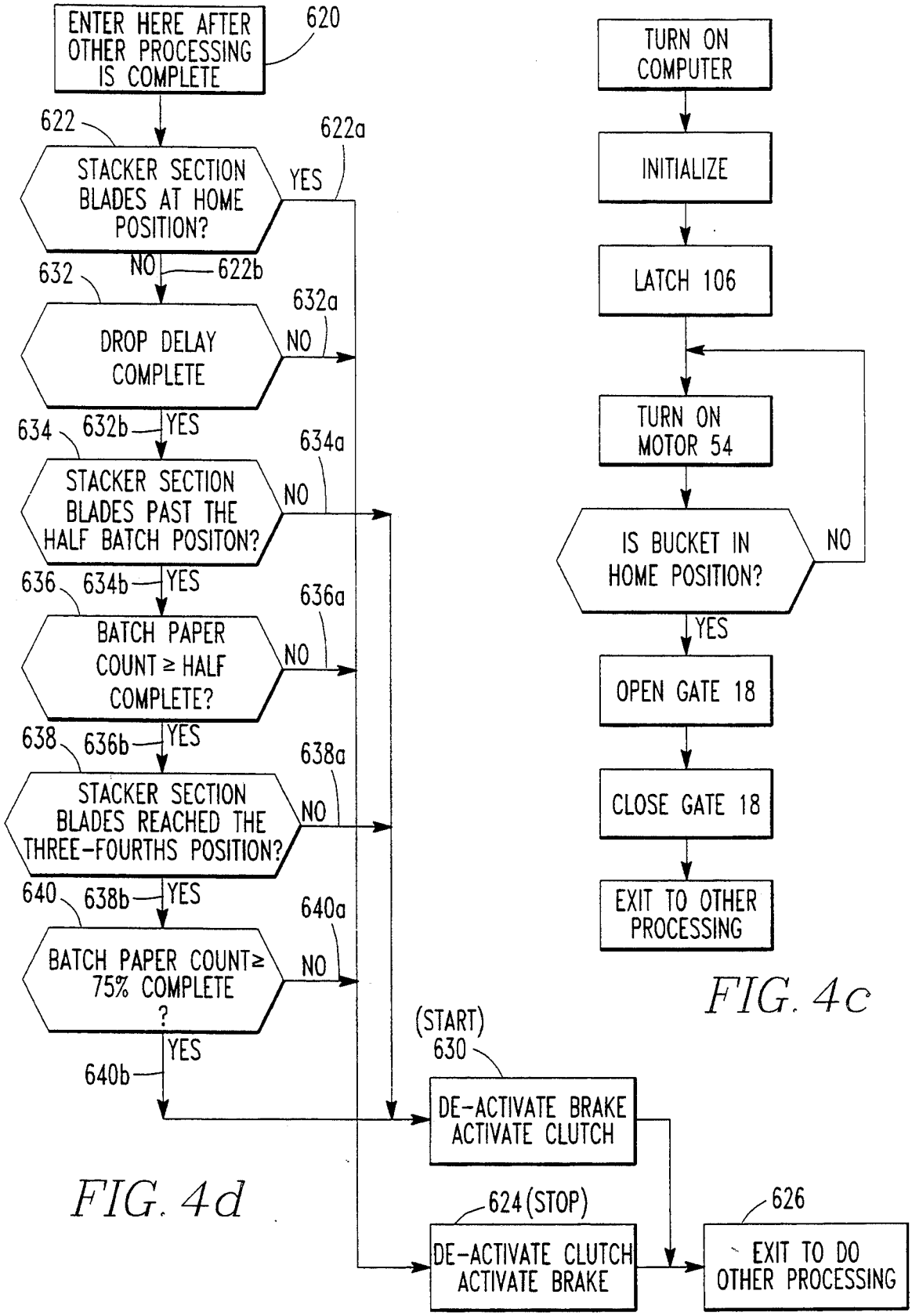

Generally describing the operation, when a bucket B is unlatched from the home position shown at 600 (FIG. 4*b*), and upon completion of the drop delay interval, the bucket is moved towards the stage one-half position 602 occupied by bucket B', as shown in FIG. 4*b*. At this time, if the count of signatures sensed by sensor 20 represents one-half of a full batch count, or greater, controller 24 continues to move the bucket towards the three-fourths batch position. If the count represents less than one-half of a batch, controller 24 disengages clutch 64 and engages brake 66 to retain the bucket at the stage one-half position 602 occupied by the bucket B' shown in FIG. 4*b*. The bucket is then driven toward the stage three-quarter position when the count reaches a value representative of one-half of a batch.

When the bucket reaches the stare three-quarter position 604, the count is again examined. If the count is a value less than three-quarters of a batch, the bucket is halted until the count reaches a value representative of the three-quarter batch count value. Conversely, if the count is at least equal to a value representative of three-quarters of a batch, the bucket continues to move toward the bottom position 606.

The flow diagram representing the control steps of staging performed by controller 24 is shown in FIG. 4*d*. The controller 24 controls all the operations of the stacker in accordance with a pre-stored program, preferably stored in a read only memory (ROM). The program is comprised of a plurality of relatively independent sub-programs or sub-routines, each of which are provided to perform a certain task. For at least certain ones of these sub-routines, the program returns to such sub-routines on a regular, periodic basis and upon completion of other routines. The control steps for performing staging comprise one of these sub-routines. As shown in FIG. 4*d*, upon completion of other processing activity, at program step 620, the program enters into the staging sub-routine. At step 622, controller 24 examines the home sensor 610 to determine if one of the buckets 30 is latched in the home position.

In the event that sensor 610 indicates a bucket, such as, for example, a bucket B (FIG. 4*a*) is latched in the home position, the sub-routine branches to output 622*a*, causing the selection of program step 624 which deactivates clutch 64 and activates brake 66 (shown in FIG. 4*a*) to stop the bucket.

The program then advances to step 626, enabling the controller 24 to attend to other processing activities, one of which is release of latch 98. The latch valve is energized after the first paper in the subsequent batch is counted, and before the first paper reaches the free tips of the tines 84-1 through 84-3.

The controller 24 returns to the sub-routine of FIG. 4*d* typically within milliseconds, and advancing to step 622 again examines the sensor 610. Assuming that the previous bucket has received its desired count of signatures and the bucket in the latched position has been unlatched, controller 24 branches to 622*b*, advancing the routine to step 632. The drop delay is examined at this time. The drop delay parameter, which is adjustably selectable, is stored in an appropriate location, preferably in memory (RAM). The drop delay period starts when the latch 98 at the home position is cleared and has a duration determined by program variables. The bucket starts to move and yet, at least for a short time, partially supports the batch as gravity accelerates the batch downward. At the end of the drop delay, clutch 64 and brake 66 operate to start the movement of the bucket. The last papers catch up to the top of the batch being formed as that batch is moving downward, sufficiently to control the otherwise free fall of the last few papers. Therefore, the drop delay duration is a consequence of stream velocity, catch-up distance, responsiveness of clutch 64, brake 66 and downward acceleration of the bucket.

The acceptable range of the drop delay parameter value is between 0 and 0.15 seconds, in the preferred embodiment. In the event that the drop delay has not timed out, the routine branches at 632*a*, and advances to step 624 where clutch 64 is deactivated and brake 66 is activated to stop the bucket, the controller 24 thereafter returning to other processing through step 626.

Assuming that the drop delay is now complete, the routine branches at 632*b* to advance to step 634 to determine if the stacker bucket tines have passed the first staging position. This is determined by the number of pulses accumulated from the encoder pick-up 116, shown in FIG. 4*a*. Each pulse represents an increment of distance travelled by the bucket and a predetermined number of pulses represents travel of the bucket to the first staging position. In the event that the bucket has not reached the first staging position, the routine branches at 634*a* to step 630, maintaining brake 66 deactivated and clutch 64 engaged to continue to move the bucket 30 toward the first staging position.

In the event that the number of pulses accumulated by encoder 116 indicates that the bucket has reached the first staring (one-half) position, the routine branches at 634*b* and advances to step 636 to examine the newspaper counter accumulating pulses from sensor 20 to determine if the counter has reached a count which is representative of one-half of a complete batch. In the event that this representative court has not been reached, the program branches at 636*a* to advance to step 624, deactivate clutch 64 and activate brake 66, allowing the signatures representing a count of one-half of a full batch counted by the counter.

In the event that the count is representative of a first staging count, the program branches at 636*b* to step 638, at which time the controller 24 examines the accumulated count of pulses developed by the encoder pick-up 116 to determine if the bucket has moved to the second (three-quarter) staging position. In the event that the bucket has reached the second staging at which time the counter should have accumulated a count representative of three-quarters of a signature batch, the program branches at 638*b* to advance to step 640. In the event that the bucket has not yet reached the second (three-quarters) staging position, the program branches to 638*a*, causing the clutch 64 to be maintained activated and causing the brake 66 to be maintained deactivated at Step 630, whereupon controller 24 returns to one of the other processing routines through step 626.

In the event that the bucket has reached the second staging position at the time program step 638 is reached, the program branches at 638*b* to step 640, to determine if three-quarters of the signatures which will make up the batch presently being formed have been counted. In the event that three-quarters of the signatures have yet to be counted, the program branches at 640*a* to step 624, causing brake 66 to be activated and clutch 64 to be deenergized to provide additional time for the signatures to reach the bucket.

In the event that three-quarters of the signatures have been counted, the program branches at 640*b* to step 630, causing brake 66 to be deactivated and clutch 64 to be activated, to enable the bucket to move from the three-quarters position 604 shown in FIG. 4*b*, toward the home position.

Each time the steps 630 and 624 are completed, the controller 24 returns to other processing routines and within an interval measured in milliseconds, returns to the routine shown in FIG. 4*d* to monitor the stacking section at intervals sufficient to be assured of proper operation of the stacking section and yet avoid the need to be constantly monitoring the stacking section without interruption.

Although the above-described routine provides for first and second staring operations, it should be understood that other staging positions may be selected pending only upon the needs of the particular application. In addition, additional staging operations may be provided for more than two staging positions. For example, three staging positions may be examined, including 40%, 60% and 80% batch staging positions. Alternatively, other choices may be made, dependent upon the needs of the particular application.

A latitude of modification change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Stacker apparatus comprising a plurality of buckets;

means for moving the buckets through a stacking region between a home position and a drop position;

means for delivering a stream of overlapping signatures to said buckets as they move through a stacking region;

latch means for releasably latching a bucket in the home position;

means for counting signatures delivered to said stacking region;

first sensing means for generating signals representing the movement of a bucket from the home position towards the drop position;

means for accumulating said signals when said latching means is released;

means for periodically examining the accumulating means;

first staging means activated by said examining means and responsive to said counting means and said sensing means for either halting said moving means when said accumulating means reaches a first predetermined value and said counting means has not reached a first predetermined count, or for generating a control signal to operate said moving means when said accumulating means reaches said first predetermined value and said counting means has reached said first predetermined count.

2. The stacker apparatus of claim 1 further comprising:

second staging means activated by said first staging means and responsive to said accumulating means reaching a second predetermined value and said counting means not reaching a second predetermined count for halting said moving means.

3. The stacker apparatus of claim 2, wherein said second staging means does not halt said moving means when said accumulating means reaches said second predetermined value and said counting means reaches said second predetermined count.

4. The stacker apparatus of claim 3 further comprising means responsive to a change in condition of said moving means from moving to halting or from halting to moving for indicating the completion of a staging operation to enable the initiation of other activities.

5. The stacker apparatus of claim 4 further comprising a motor;

said moving means including clutch means selectively coupling said moving means to said motor when not halted by said staging means and decoupling said moving means from said motor when halted by either of said staging means.

6. The stacker apparatus of claim 5 further comprising brake means for braking said moving means whenever said clutch means decouples said moving means from said motor and for releasing said moving means whenever said clutch means couples said moving means to said clutch means.

7. The stacker apparatus of claim 2 further comprising means activated by said periodic examining means for halting said moving means when a bucket has reached said home position.

8. A method for operating a stacker having a plurality of buckets and means for moving the buckets through a stacking region between a home position and a drop position;

means for delivering a stream of overlapping signatures to said buckets as they move through to said stacking region;

latch means for releasably latching a bucket in the home position;

means for counting signatures delivered to said stacking region;

first sensing means for generating signals representing the movement of a bucket from the home position towards the drop position;

means for accumulating said signals when said latching means is released;

the method comprising the steps of:

initiating a staging cycle at periodic intervals;

examining said home position upon initiation of a staging cycle;

halting the moving means when a bucket has reached the home position, indicating the end of a staging routine when said moving means changes its operating state;

examining the accumulating means if no bucket has reached the home position; and preventing the halting of the moving means if the accumulating means has reached a first predetermined value, which value indicates that the bucket has reached a first staging location and indicating the completion of a staging routine;

examining the counting means when the accumulating means value indicates that the bucket has reached the first staging location;

halting the moving means if the bucket has reached the first staging location and the count in the counting means indicates that the number of signatures delivered to the bucket has not reached a first staging count; and indicating that a staging routine has been completed.

9. The method of claim 8 further comprising the steps of:

examining the accumulating means when the counting means reaches said first staging count to determine if the bucket has reached a second staging location;

preventing halting of the moving means if the bucket has not reached the second staging location and indicating the completion of a staging routine;

examining the counting means when the bucket has reached the second staging location;

halting the moving means if the count has not reached a count representing the second staging count and indicating the completion of a staging routine;

preventing the halting of the moving means if the bucket has received the second staging count of signatures and indicating the completion of a staging routine.

10. The method of claim 9, wherein a periodic initiation of said staging routine is executed only if an indication of a completed staging routine has occurred.

11. A signature stacker, comprising:

at least one signature support;

means for moving the signature support through a stacking region;

means for delivering a stream of signatures to the signature support as the signature support moves through the stacking region;

means for counting signatures delivered to the stacking region;

means for monitoring the position of the signature support as it moves through the stacking region; and means for controlling the movement of the signature support through the stacking region by synchronizing movement of the signature support into predetermined positions in the stacking region with the delivery of a corresponding predetermined count of the signatures to the signature support.

12. A signature stacker, comprising:

at least one signature support;

means for moving the signature support through a stacking region;

means for delivering a stream of signatures to the signature support as the signature support moves through the stacking region;

means for counting signatures delivered to the stacking region;

means for monitoring the position of the signature support as it moves through the stacking region; and means for controlling the movement of the signature support through the stacking region by synchronizing incremental movement of the signature support through the stacking region with the delivery of a corresponding predetermined count of the signatures to the signature support.

13. A signature stacker, comprising:

at least one signature support;

means for moving the signature support through a stacking region;

means for delivering a stream of signatures to the signature support as the signature support moves through the stacking region;

means for counting signatures delivered to the stacking region;

means for monitoring the position of the signature support as it moves through the stacking region; and means responsive to the counting means and the monitoring means for delaying movement of the signature support by the moving means when the signature support reaches a predetermined position in the stacking region and the counting means has not reached a predetermined count for the predetermined position reached by the signature support.

14. A signature stacker, comprising:

at least one signature support;

means for moving the signature support through a stacking region;

means for delivering a stream of signatures to the signature support as the signature support moves through the stacking region;

means for counting signatures delivered to the stacking region;

means for monitoring the position of the signature support as it moves through the stacking region; and means responsive to the counting means and the monitoring means for delaying movement of the signature support by the moving means whenever the signature support reaches any one of a plurality of predetermined positions in the stacking region and the counting means has not reached a predetermined count which represents the number of signatures which should be delivered to the signature support when the signature support occupies one of said predetermined positions.

15. A method for stacking signatures, comprising:

moving a signature support through a stacking region;

delivering a stream of signatures to the signature support as the signature support moves through the stacking region;

counting signatures delivered to the stacking region;

monitoring the position of the signature support as it moves through the stacking region; and controlling the movement of the signature support through the stacking region by synchronizing movement of the signature support into predetermined positions in the stacking region with the delivery of a corresponding predetermined count of the signatures to the signature support.

16. A method for stacking signatures, comprising:

moving a signature support through a stacking region;

delivering a stream of signatures to the signature support as the signature support moves through the stacking region;

counting signatures delivered to the stacking region;

monitoring the position of the signature support as it moves through the stacking region; and controlling the movement of the signature support through the stacking region by synchronizing incremental movement of the signature support through the stacking region with the delivery of a corresponding predetermined count of the signatures to the signature support.

17. A method for stacking signatures, comprising:

moving a signature support through a stacking region;

delivering a stream of signatures to the signature support as the signature support moves through the stacking region;

counting signatures delivered to the stacking region;

monitoring the position of the signature support as it moves through the stacking region; and delaying the movement of the signature support when the signature support reaches a predetermined position in the stacking region and the counting means has not reached a predetermined count for the predetermined position reached by the signature support.

18. A method for stacking signatures, comprising:

moving a signature support through a stacking region;

delivering a stream of signatures to the signature support as the signature support moves through the stacking region;

counting signatures delivered to the stacking region;

monitoring the position of the signature support as it moves through the stacking region; and delaying the movement of the signature support whenever the signature support reaches any one of a plurality of predetermined positions in the stacking region and the counting means has not reached a predetermined count corresponding to the predetermined position reached by the signature support.

* * * * *

UNITED STATES PATENT AND TRADEMARK OFFICE

CERTIFICATE OF CORRECTION

PATENT NO. : 5,338,149

DATED : August 16, 1994

INVENTOR(S) : Raymond Wiseman

It is certified that error appears in the above-identified patent and that said Letters Patent is hereby corrected as shown below:

Claim 8, Column 26, line 10 reads "tures to said buckets as they move through to said" but should read --tures to said buckets as they move through said--.

Signed and Sealed this

Eighteenth Day of October, 1994

*Attest:*

Bruce Lehman

BRUCE LEHMAN

*Attesting Officer*

*Commissioner of Patents and Trademarks*